US012590750B2

(12) United States Patent
Jung et al.

(10) Patent No.: US 12,590,750 B2
(45) Date of Patent: Mar. 31, 2026

(54) REFRIGERATOR

(71) Applicant: SAMSUNG ELECTRONICS CO., LTD., Suwon-si (KR)

(72) Inventors: Taeyun Jung, Suwon-si (KR); Donghwa Kim, Suwon-si (KR); Kangil Song, Suwon-si (KR); Donghak Heo, Suwon-si (KR); Hyesung Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 87 days.

(21) Appl. No.: 18/419,425

(22) Filed: Jan. 22, 2024

(65) Prior Publication Data

US 2024/0191929 A1 Jun. 13, 2024

Related U.S. Application Data

(63) Continuation of application No. PCT/KR2022/012166, filed on Aug. 16, 2022.

(30) Foreign Application Priority Data

Sep. 10, 2021 (KR) ..... 10-2021-0121299

(51) Int. Cl.
*F25D 11/02* (2006.01)
*F25D 17/06* (2006.01)
*F25D 23/06* (2006.01)

(52) U.S. Cl.
CPC ..... *F25D 11/02* (2013.01); *F25D 17/062* (2013.01); *F25D 23/065* (2013.01); *F25D 2201/12* (2013.01)

(58) Field of Classification Search
CPC ..... F25D 11/02; F25D 17/062; F25D 23/065; F25D 2201/12
See application file for complete search history.

(56) References Cited

U.S. PATENT DOCUMENTS 5,997,076 A * 12/1999 Ehrlich ..... B62D 33/046 296/186.1
7,430,876 B2 10/2008 Iguchi et al.
(Continued)

FOREIGN PATENT DOCUMENTS

CN 110411113 A 11/2019
JP 2581341 Y2 9/1998
(Continued)

OTHER PUBLICATIONS

International Search Report and Written Opinion of the International Searching Authority dated Dec. 2, 2022, in connection with International Application No. PCT/KR2022/012166, 9 pages.
(Continued)

*Primary Examiner* — Monica E Millner

(57) ABSTRACT

Disclosed is a refrigerator that does not include a separate partition member disposed between an upper inner case and a lower inner case to reduce storage costs, logistics costs, and production costs, and to increase productivity. The refrigerator includes n first and second inner cases forming a first and second storage compartments and including a plurality of first and second plates each formed by injection molding; an outer case coupled to an outer side of the first and second inner cases to form an exterior of the refrigerator; an insulation provided between the first and second inner cases and the outer case and between the first inner case and the second inner case; and a cold air guide surrounded by the insulation between the first and second inner cases, and configured to form a cold air flow path communicating the first and second storage compartments.

19 Claims, 16 Drawing Sheets

(56) References Cited

U.S. PATENT DOCUMENTS

| | | | | |
|---|---|---|---|---|
| 7,942,017 | B2 * | 5/2011 | Lee | F25C 5/22 62/344 |
| 9,207,010 | B2 | 12/2015 | Jung et al. | |
| 9,945,600 | B2 | 4/2018 | Kang | |
| 10,520,239 | B2 | 12/2019 | Chezem et al. | |
| 10,852,050 | B2 * | 12/2020 | Im | F25D 17/065 |
| 11,047,608 | B2 * | 6/2021 | Kim | F25D 11/02 |
| 11,408,662 | B2 * | 8/2022 | Lee | F25D 17/045 |
| 11,480,377 | B2 * | 10/2022 | Kim | F25C 1/10 |
| 11,698,217 | B2 | 7/2023 | Kim et al. | |
| 11,859,893 | B2 * | 1/2024 | Jeong | F25C 1/24 |
| 2006/0201185 | A1 | 9/2006 | Takaoka | |
| 2008/0202149 | A1 * | 8/2008 | Lim | F25D 17/067 62/407 |
| 2011/0072843 | A1 * | 3/2011 | Cho | F25D 23/066 62/407 |
| 2017/0122649 | A1 * | 5/2017 | Im | F25D 17/067 |
| 2019/0041119 | A1 * | 2/2019 | Kim | F25D 17/08 |
| 2020/0096245 | A1 * | 3/2020 | Besore | F25D 23/028 |
| 2020/0248950 | A1 * | 8/2020 | Schork | F25D 17/065 |
| 2020/0370817 | A1 | 11/2020 | Nam et al. | |
| 2021/0055037 | A1 | 2/2021 | Jung et al. | |
| 2022/0196315 | A1 * | 6/2022 | Kim | F25D 17/065 |
| 2023/0349627 | A1 | 11/2023 | Jung et al. | |

FOREIGN PATENT DOCUMENTS

| | | | |
|---|---|---|---|
| JP | 2003-056975 | A | 2/2003 |
| JP | 2003-090676 | A | 3/2003 |
| JP | 2003-322442 | A | 11/2003 |
| JP | 2005-291523 | A | 10/2005 |
| JP | 2013-007439 | A | 1/2013 |
| KR | 10-1758277 | B1 | 7/2017 |
| KR | 10-1832763 | B1 | 2/2018 |
| KR | 10-2018-0066497 | A | 6/2018 |
| KR | 10-2019-0122435 | A | 10/2019 |
| KR | 10-2021-0063300 | A | 6/2021 |
| KR | 10-2021-0092410 | A | 7/2021 |

OTHER PUBLICATIONS

Supplementary European Search Report dated Sep. 3, 2024, in connection with European Patent Application No. 22867580.7, 6 pages.

* cited by examiner

REFRIGERATOR

CROSS-REFERENCE TO RELATED APPLICATIONS

This application is a bypass continuation of International Application No. PCT/KR2022/012166, filed Aug. 16, 2022, which claims priority to Korean Patent Application No. 10-2021-0121299, filed Sep. 10, 2021, the disclosures of which are herein incorporated by reference in their entirety.

BACKGROUND

1. Field

The disclosure relates to a refrigerator including a prefabricated inner case.

2. Description of Related Art

A refrigerator is a device that is composed of a main body including a storage compartment, and a cold air supply system for supplying cold air to the storage compartment so as to keep food fresh. The storage compartment includes a refrigerating compartment maintained at approximately 0 to 5° C. to store food in a refrigerated manner, and a freezing compartment maintained at approximately 0 to −30° C. to store food in a frozen manner.

An inner case and an outer case are coupled to each other to form the main body of the refrigerator. The inner case forms the storage compartment, and the outer case forms the exterior of the refrigerator. An insulation for thermal insulation is arranged between the inner case and the outer case. The storage compartment of the refrigerator is provided with an open front side, and the open front side is closed to maintain a temperature of the storage compartment.

In general, the inner case of the refrigerator is manufactured in a vacuum forming process such that a sheet of resin material is heated, the stretched sheet is put on a mold, air is drawn in from an opposite side of the mold, and the heated sheet covers the mold or is drawn into the inside of the mold by the intake force.

The inner case formed in the vacuum forming process is not uniform in thickness and has variations. Due to the thickness deviation of the inner case, the quality of the appearance inside the storage compartment may be reduced.

In the inner case formed in the vacuum forming process, an upper inner case forming an upper storage compartment and a lower inner case forming a lower storage compartment are integrally formed, and a separate partition member is disposed in a space between the upper inner case and the lower inner case.

The partition member is disposed in the space to support the upper inner case and forms a cold air flow path communicating the upper storage compartment and the lower storage compartment. However, the partition member has disadvantages in storage and transportation due to its relatively large volume. In addition, the partition member has a complex structure and high production costs.

SUMMARY

An aspect of the disclosure provides a refrigerator that may, when loading and storing an inner case, store a larger number of inner cases in the same space by allowing the inner case to be disassembled, and may transport a larger number of inner cases at a time.

Another aspect of the disclosure provides a refrigerator including an inner case formed by assembling parts formed by an injection molding method.

Still other aspect of the disclosure provides a refrigerator including a cold air guide that directly connects an upper inner case and a lower inner case without a separate partition member.

Yet other aspect of the disclosure provides a refrigerator that may maintain a gap between an upper inner case and a lower inner case with a simple structure without a separate partition member disposed between the upper inner case and the lower inner case.

Further aspect of the disclosure provides a refrigerator that does not include a separate partition member disposed between an upper inner case and a lower inner case, thereby reducing storage costs, logistics costs, and production costs, and increasing productivity.

According to an aspect of the disclosure, a refrigerator may include a first inner case forming a first storage compartment and including a plurality of first plates each formed by an injection molding; a second inner case forming a second storage compartment and including a plurality of second plates each formed by an injection molding; an outer case coupled to an outer side of the first inner case and an outer side of the second inner case to form an exterior of the refrigerator; an insulation provided between the first inner case and the outer case, between the second inner case and the outer case, and between the first inner case and the second inner case; and a cold air guide surrounded by the insulation between the first inner case and the second inner case, and configured to form a cold air flow path communicating the first storage compartment and the second storage compartment.

The plurality of first plates may include a first lower plate forming a lower surface of the first storage compartment.

The plurality of second plates may include a second upper plate forming an upper surface of the second storage compartment.

The first lower plate may include a first hole formed through the first lower plate.

The second upper plate may include a second hole formed through the second upper plate.

The cold air guide may be configured to connect the first hole and the second hole to form the cold air flow path.

The cold air guide and the first lower plate may be sealed to prevent the insulation from flowing into the cold air flow path through the cold air guide member and the first lower plate.

The cold air guide and the second upper plate may be sealed to prevent the insulation from flowing into the cold air flow path through the cold air guide and the second upper plate.

The first lower plate may include a first sealing rib formed along a circumference of the first hole and protruding downward from the first lower plate.

The second upper plate may include a second sealing rib formed along a circumference of the second hole and protruding upward from the second upper plate.

The cold air guide may include a first flange provided at one end of the cold air guide and coupled to the first lower plate to cover the first hole and the first sealing rib; and a second flange provided at another end of the cold air guide and coupled to the second upper plate to cover the second hole and the second sealing rib.

A lower end of the first sealing rib may be provided to contact the first flange so as to prevent inflow of the insulation.

An upper end of the second sealing rib may be provided to contact the second flange so as to prevent inflow of the insulation.

The lower end of the first sealing rib may be provided to contact the first flange, when the cold air guide is located at a predetermined position with respect to the first lower plate.

The first lower plate may further include a guide configured to guide the cold air guide to allow the cold air guide to be located at the predetermined position.

The guide may include a guide surface configured to contact the first flange so as to guide the first flange, when the cold air guide moves toward the first lower plate to be coupled to the first lower plate.

The first flange may be guided to the predetermined position by moving along the guide surface.

The second upper plate may include a flange coupler coupled to the second flange to fix the cold air guide to the second upper plate.

The upper end of the second sealing rib may be provided to contact the second flange, when the second flange is coupled to the flange coupler.

The flange coupler may include: a coupling rib forming a flange groove into which the second flange is inserted; a cover provided to cover one end of the second flange and extending from the coupling rib; and a coupling protrusion provided on the coupling rib and coupled to the second flange to prevent the second flange from being withdrawn from the flange groove.

The cold air guide may include: a first recess formed by recessing a portion of the second flange and covered by the cover, and a second recess formed by recessing a portion of the second flange to allow the coupling protrusion to be inserted.

The refrigerator may further include: a first support protrusion that protrudes downward from the first lower plate, and a second support protrusion that protrudes upward from the second upper plate.

The first support protrusion and the second support protrusion contact each other to maintain a gap between the first inner case and the second inner case.

The first support protrusion may be formed integrally with the first lower plate.

The second support protrusion may be formed integrally with the second upper plate.

The first support protrusion and the second support protrusion may be provided to contact at two regions spaced apart from each other to reduce a contact area between the first support protrusion and the second support protrusion.

According to an aspect of the disclosure, a refrigerator may include: a first inner case forming a first storage compartment and including a first lower plate and a plurality of first plates each formed by an injection molding; a second inner case forming a second storage compartment and including a second upper plate and a plurality of second plates each formed by an injection molding; an outer case coupled to an outer side of the first inner case and an outer side of the second inner case to form an exterior of the refrigerator; an insulation provided between the first inner case and the outer case, between the second inner case and the outer case, and between the first inner case and the second inner case; a first support protrusion that protrudes downward from the first lower plate, a second support protrusion that protrudes upward from the second upper plate and contacts the first support protrusion to maintain a gap between the first inner case and the second inner case; and a cold air guide disposed between the first inner case and the second inner case to maintain a gap between the first inner case and the second inner case, and configured to form a cold air flow path communicating the first storage compartment and the second storage compartment.

The first lower plate may include a first hole formed through the first lower plate, and a first sealing rib formed along a circumference of the first hole and protruding downward from the first lower plate.

The second upper plate may include a second hole formed through the second upper plate, and a second sealing rib formed along a circumference of the second hole and protruding upward from the second upper plate.

The cold air guide may include a first flange provided at one end of the cold air guide and coupled to the first lower plate to cover the first hole and the first sealing rib; and a second flange provided at another end of the cold air guide and coupled to the second upper plate to cover the second hole and the second sealing rib.

A lower end of the first sealing rib may be provided to contact the first flange so as to prevent inflow of the insulation.

An upper end of the second sealing rib may be provided to contact the second flange so as to prevent inflow of the insulation.

The first support protrusion and the second support protrusion may be provided to contact at two regions spaced apart from each other to reduce a contact area between the first support protrusion and the second support protrusion.

An aspect of the disclosure provides a refrigerator that may, when loading and storing an inner case, store a larger number of inner cases in the same space by allowing the inner case to be disassembled, and may transport a larger number of inner cases at a time.

An aspect of the disclosure provides a refrigerator including an inner case formed by assembling parts formed by an injection molding method.

An aspect of the disclosure provides a refrigerator including a cold air guide that directly connects an upper inner case and a lower inner case without a separate partition member.

An aspect of the disclosure provides a refrigerator that may maintain a gap between an upper inner case and a lower inner case with a simple structure without a separate partition member disposed between the upper inner case and the lower inner case.

An aspect of the disclosure provides a refrigerator that does not include a separate partition member disposed between an upper inner case and a lower inner case, thereby reducing storage costs, logistics costs, and production costs, and increasing productivity.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like;

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
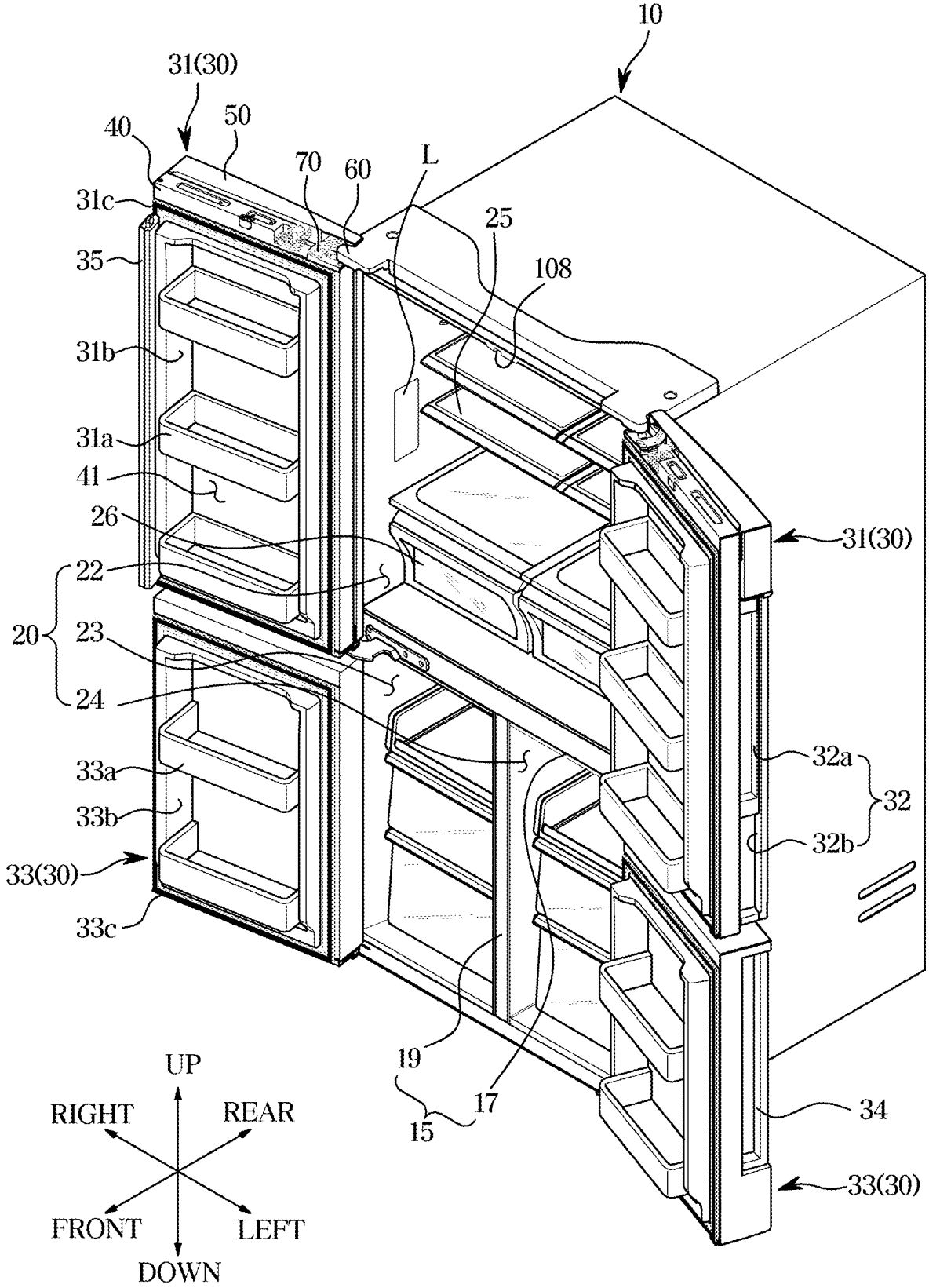
FIG. 1 is a perspective view of a refrigerator with an open door according to an embodiment of the disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure, and may be modified in various different ways at the time of filing of the application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "rear", "left", "right" and the like may be defined by the drawings, but the shape and the location of the component is not limited by the term.

Hereinafter, embodiments of the disclosure will be described in detail with reference to the accompanying drawings.

Figure 2:
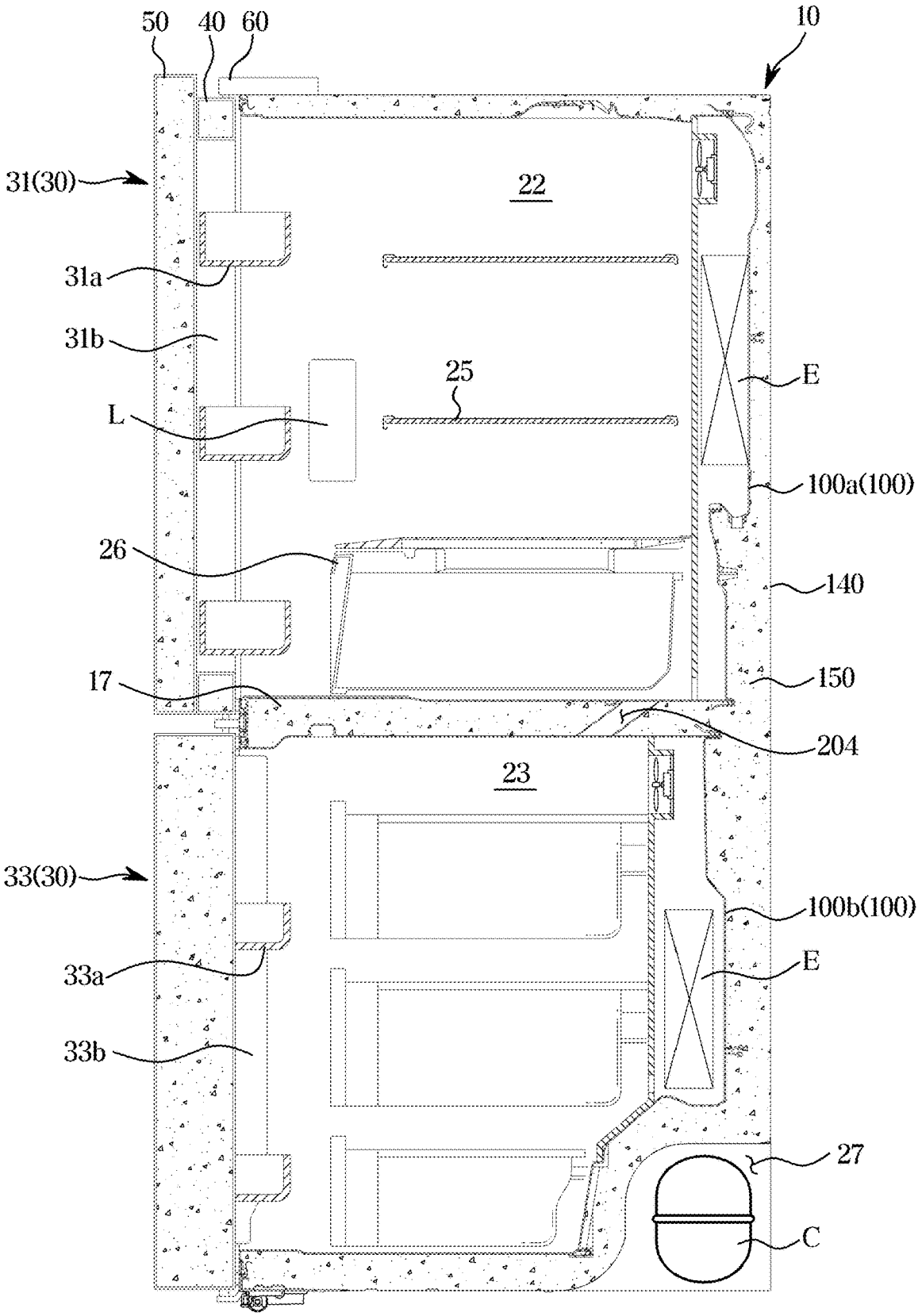
FIG. 2 is a schematic side cross-sectional view of a refrigerator according to an embodiment of the disclosure.

FIG. 1 is a perspective view of a refrigerator with an open door according to an embodiment of the disclosure. FIG. 2 is a schematic side cross-sectional view of a refrigerator according to an embodiment of the disclosure.

In the description, up, down, left, right, front and rear directions are defined based on a direction illustrated in FIG. 1.

As illustrated in FIGS. 1 and 2, a refrigerator 1 may include a main body 10, a storage compartment 20 vertically partitioned inside the main body 10, a door 30 to open or close the storage compartment 20, and a cold air supply device (not shown) to supply cold air to the storage compartment 20.

The main body 10 may include an inner case 100 forming the storage compartment 20, an outer case 140 coupled to an outside of the inner case 100 to form an exterior, and an insulation 150 foamed between the inner case 100 and the outer case 140 to insulate the storage compartment 20.

A machine room 27, in which a compressor C compressing a refrigerant and a condenser (not shown) condensing the refrigerant compressed by the compressor C are installed, may be provided at a rear lower portion of the main body 10.

The cold air supply device may include the compressor C compressing the refrigerant, the condenser (not shown) condensing the refrigerant, an expansion valve (not shown) expanding the refrigerant, and an evaporator E evaporating the refrigerant.

The storage compartment 20 may be divided into a plurality by a partition 15, and a plurality of shelves 25 and storage containers 26 may be provided in the storage compartment 20 to store food, and the like.

The storage compartment 20 may be divided into a plurality of storage compartments 22, 23, and 24 by the partition 15, and the partition 15 may include a first partition 17 horizontally coupled to the inside of the storage compartment 20 to divide the storage compartment 20 into an upper storage compartment 22 and lower storage compartments 23 and 24, and a second partition 19 vertically coupled to the inside of the lower storage compartments 23 and 24 to divide the lower storage compartments 23 and 24 into the first storage compartment 23 and the second storage compartment 24.

The partition 15 having a T-shape formed by the first partition 17 and the second partition 19 coupled to each other may divide the storage compartment 20 into three spaces. Among the upper storage compartment 22 and the lower storage compartments 23 and 24 divided by the first partition 17, the upper storage compartment 22 may be used as a refrigerating compartment, and the lower storage compartments 23 and 24 may be used as a freezing compartment.

All the lower storage compartments 23 and 24 may be used as the freezing compartment. Alternatively, the first storage compartment 23 may be used as the freezing compartment and the second storage compartment 24 may be used as the refrigerating compartment. Alternatively, the first storage compartment 23 may be used as the freezing compartment, and the second storage compartment 24 may be used as both the freezing compartment and the refrigerating compartment.

Referring to FIG. 2, the upper storage compartment 22 and the lower storage compartments 23 and 24 may be communicated to allow cold air to move. Although the first storage compartment 23 of the lower storage compartments 23 and 24 is shown in FIG. 2, the second storage compartment 24 may communicate with the upper storage compartment 22. A cold air flow path 204 connecting the upper storage compartment 22 and the lower storage compartments 23 and 24 may be formed. The cold air flow path 204 may be formed by a cold air guide 200 being disposed between a first inner case 100*a* and a second inner case 100*b*. The cold air guide 200 will be described later.

According to an aspect of the disclosure, a separate partition member may not be provided between the upper storage compartment 22 and the lower storage compartments 23 and 24. A separate partition member for maintaining a gap between the first inner case 100*a* and the second inner case 100*b* may not be provided between the first inner case 100*a* forming the upper storage compartment 22 and the second inner case 100*b* forming the lower storage compartments 23 and 24. The gap between the first inner case 100*a* and the second inner case 100*b* may be maintained by a first support protrusion 260 and a second support protrusion 270 to be described later. The first support protrusion 260 may be injection molded integrally with the first inner case 100*a*, and the second support protrusion 270 may be injection molded integrally with the second inner case 100*b*. In the refrigerator 1 according to an aspect of the disclosure, because a separate partition member is not provided between the first inner case 100*a* and the second inner case 100*b*, storage costs, logistics costs, and production costs due to the separate partition member may be reduced. Furthermore, the productivity of the refrigerator 1 may be improved.

The division of the storage compartment 20 as described above is an example, and each storage compartment 22, 23, and 24 may be used differently from the above configuration.

The refrigerating compartment 22 and the freezing compartments 23 and 24 may be opened or closed by the door 30 rotatably coupled to the main body 10, respectively.

The door 30 may include a pair of refrigerating compartment doors 31 rotatably coupled to the main body 10 to open or close the refrigerating compartment 22, and a pair of freezing compartment doors 33 rotatably coupled to the main body 10 to open or close the freezing compartments 23 and 24.

The pair of refrigerating compartment doors 31 may be respectively opened or closed through a pair of refrigerating compartment door handles 32 including a first door handle 32*a* or a second door handle 32*b*. The refrigerating compartment 22 may be opened or closed by the pair of refrigerating compartment doors 31, and a rotating rod 35 may be installed on at least one of the pair of refrigerating compartment doors 31 so as to seal between the pair of refrigerating compartment doors 31 without a gap therebetween which may occur when the refrigerating compartment doors 31 are closed. The rotating rod 35 may be rotatably coupled to at least one of the pair of refrigerating compartment doors 31. The rotating rod 35 may be guided by a rotation guide 108 formed on the inner case 100, so as to rotate according to the opening and closing of the refrigerating compartment door 31.

The pair of freezing compartment doors 33 may be respectively opened or closed by a freezing compartment door handle 34. A sliding door may be applied to the door to open or close the freezing compartments 23 and 24.

Door shelves 31*a* and 33*a* in which food is stored may be provided on rear surfaces of the pair of refrigerating compartment doors 31 and the pair of freezing compartment doors 33, respectively.

The door shelves 31*a* and 33*a* may respectively include shelf supports 31*b* and 33*b* extending vertically from the doors 31 and 33 to support each of the door shelves 31*a* and 33*a* on left and right sides of each of the door shelves 31*a* and 33*a*. The shelf supports 31*b* and 33*b* may extend from the doors 31 and 33, respectively. The shelf supports 31*b* and 33*b* may be detachably provided on each door 31 and 33 as a separate configuration.

In addition, first gaskets 31*c* and 33*c* may be provided on the rear edge of each door 31 and 33 to seal a gap with the main body 10 in a state where each door 31 and 33 are closed. The first gaskets 31*c* and 33*c* may be installed in a loop shape along the edges on the rear surface of each door 31 and 33, and a magnet (not shown) may be included in the first gaskets 31*c* and 33*c*.

The pair of refrigerating compartment doors 31 to open or close the refrigerating compartment 22 may be arranged left and right. Hereinafter, for convenience of description, only the refrigerating compartment door 31 arranged on the left side of the drawing will be described, and the refrigerating compartment door 31 arranged on the left side of the drawing will be referred to as the refrigerating compartment door 31. However, the refrigerating compartment door 31 described below is not limited to the refrigerating compartment door 31 arranged on the left side of the drawing, but may also be applied to the refrigerating compartment door 31 arranged on the right side of the drawing, and applied to at least one of the pair of freezing compartment doors 33.

The refrigerating compartment door 31 may be provided as a double door including a first door 40 and a second door 50.

The first door 40 may be rotatably connected to the main body 10 by a first hinge 60 so as to open or close the refrigerating compartment 22. The above-described door shelf 31*a*, shelf support 31*b*, and first gasket 31*c* may be provided on the first door 40.

The first door 40 may include an opening 41 formed to allow a user to approach the door shelf 31*a* to insert or withdraw food while the first door 40 is closed. The opening 41 may be formed through the first door 40 and may be opened or closed by the second door 50.

The second door 50 may be provided in front of the first door 40 to open or close the opening 41 of the first door 40, and the second door 50 may be rotatable in the same direction as the first door 40. Although the drawing illustrates that the second door 50 is rotatably supported by a second hinge 70 installed on the first door 40 and is rotatable with respect to the first door 40, the disclosure is not limited thereto. The second hinge 70 may also be installed on the main body 10, and the second door 50 may be rotatable about the main body 10.

The second door 50 may include a second gasket (not shown) for maintaining airtightness with the first door 40. The second gasket may be installed in a loop shape along an edge of a rear surface of the second door 50, and a magnet (not shown) may be included therein.

Figure 3:
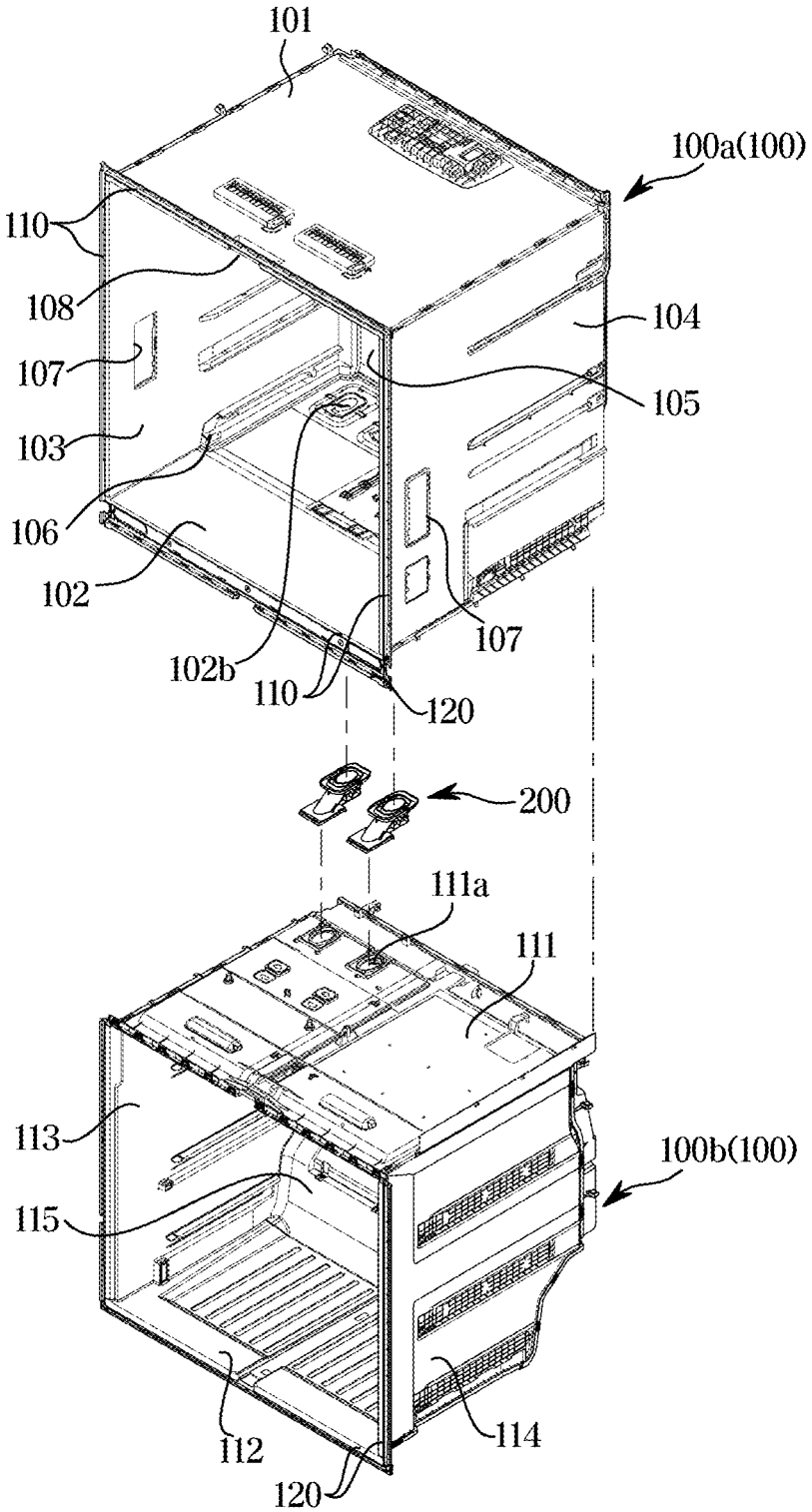
FIG. 3 is a view illustrating a state in which a first inner case, a second inner case and a cold air guide are separated from each other in a refrigerator according to an embodiment of the disclosure.
Figure 4:
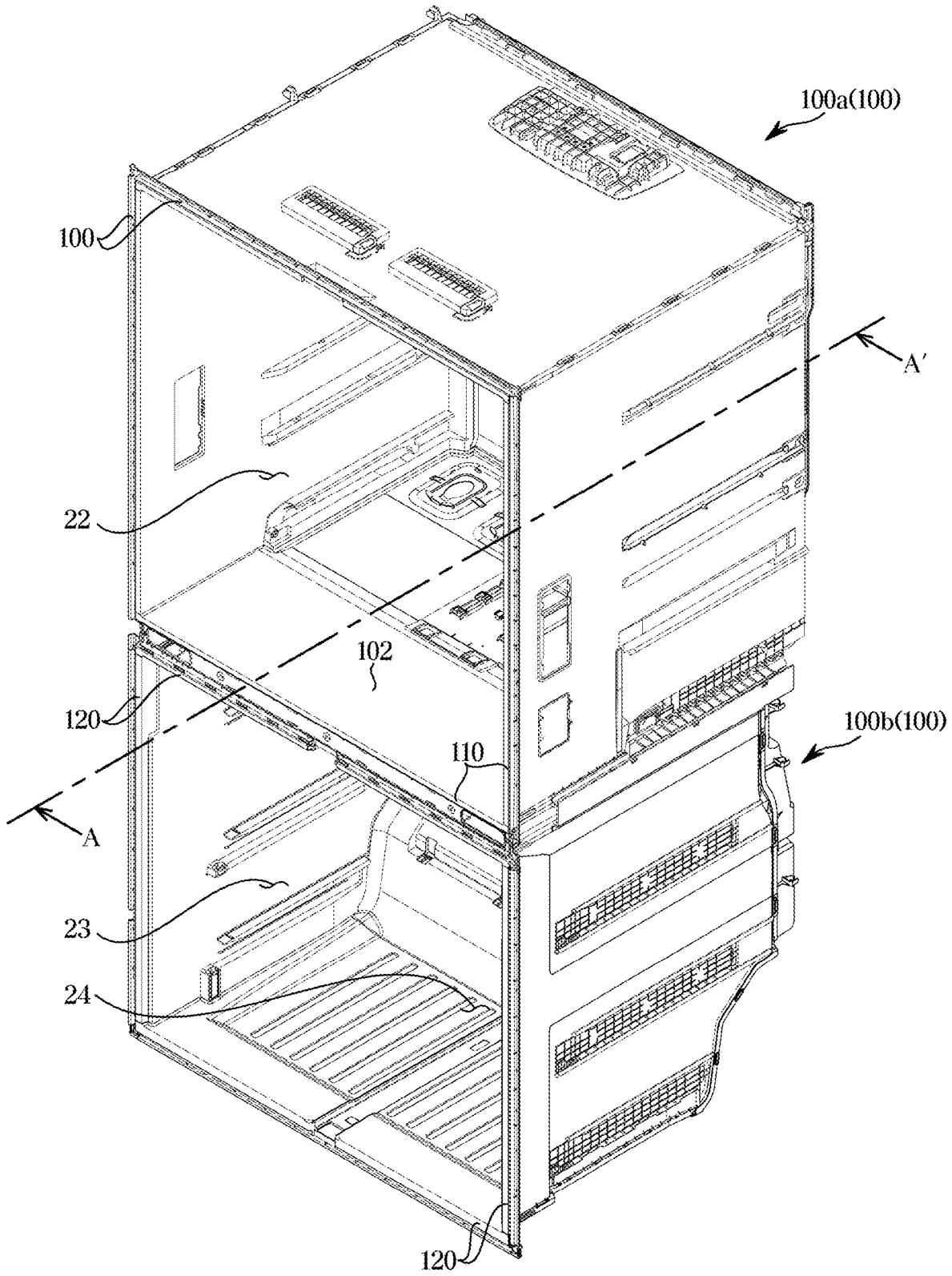
FIG. 4 is a view illustrating a state in which a first inner case, a second inner case and a cold air guide are coupled to each other in a refrigerator according to an embodiment of the disclosure.

FIG. 3 is a view illustrating a state in which a first inner case, a second inner case and a cold air guide are separated from each other in a refrigerator according to an embodiment of the disclosure. FIG. 4 is a view illustrating a state in which a first inner case, a second inner case and a cold air guide are coupled to each other in a refrigerator according to an embodiment of the disclosure.

Referring to FIG. 3 and FIG. 4, the refrigerator according to the disclosure may include the first inner case 100*a* and the second inner case 100*b*. The first inner case 100*a* and the second inner case 100*b* may be coupled to each other. The first inner case 100*a* and the second inner case 100*b* may be coupled to each other to form the inner case 100.

The cold air guide 200 may be provided between the first inner case 100*a* and the second inner case 100*b*. The cold air guide 200 may be manufactured separately from the first inner case 100*a* and the second inner case 100*b*. The cold air guide 200 may form the cold air flow path 204 communicating the upper storage compartment 22 and the lower storage compartments 23 and 24 by being disposed between the first inner case 100*a* and the second inner case 100*b*.

Figure 5:
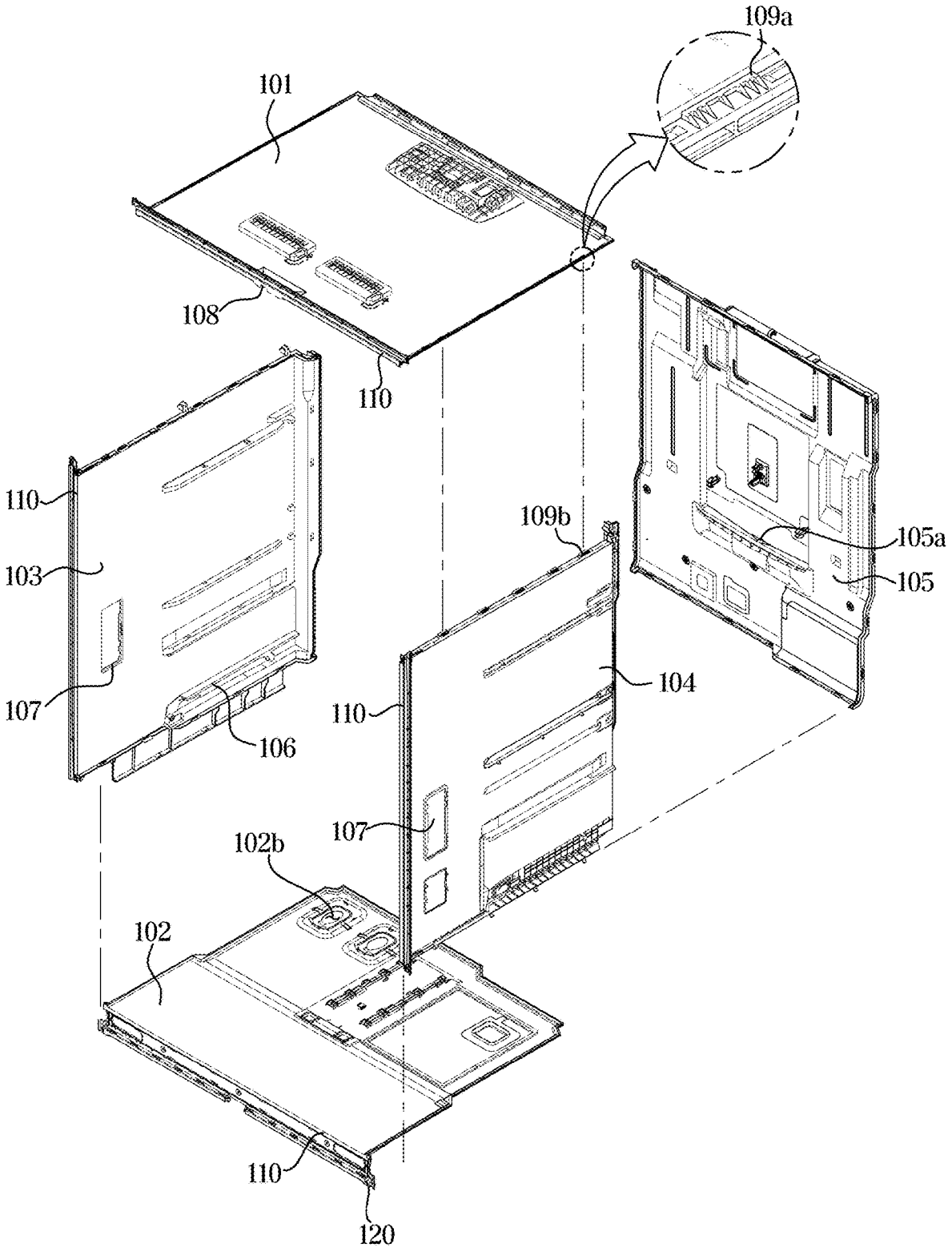
FIG. 5 is a view illustrating a state in which a first inner case is disassembled in a refrigerator according to an embodiment of the disclosure.
Figure 6:
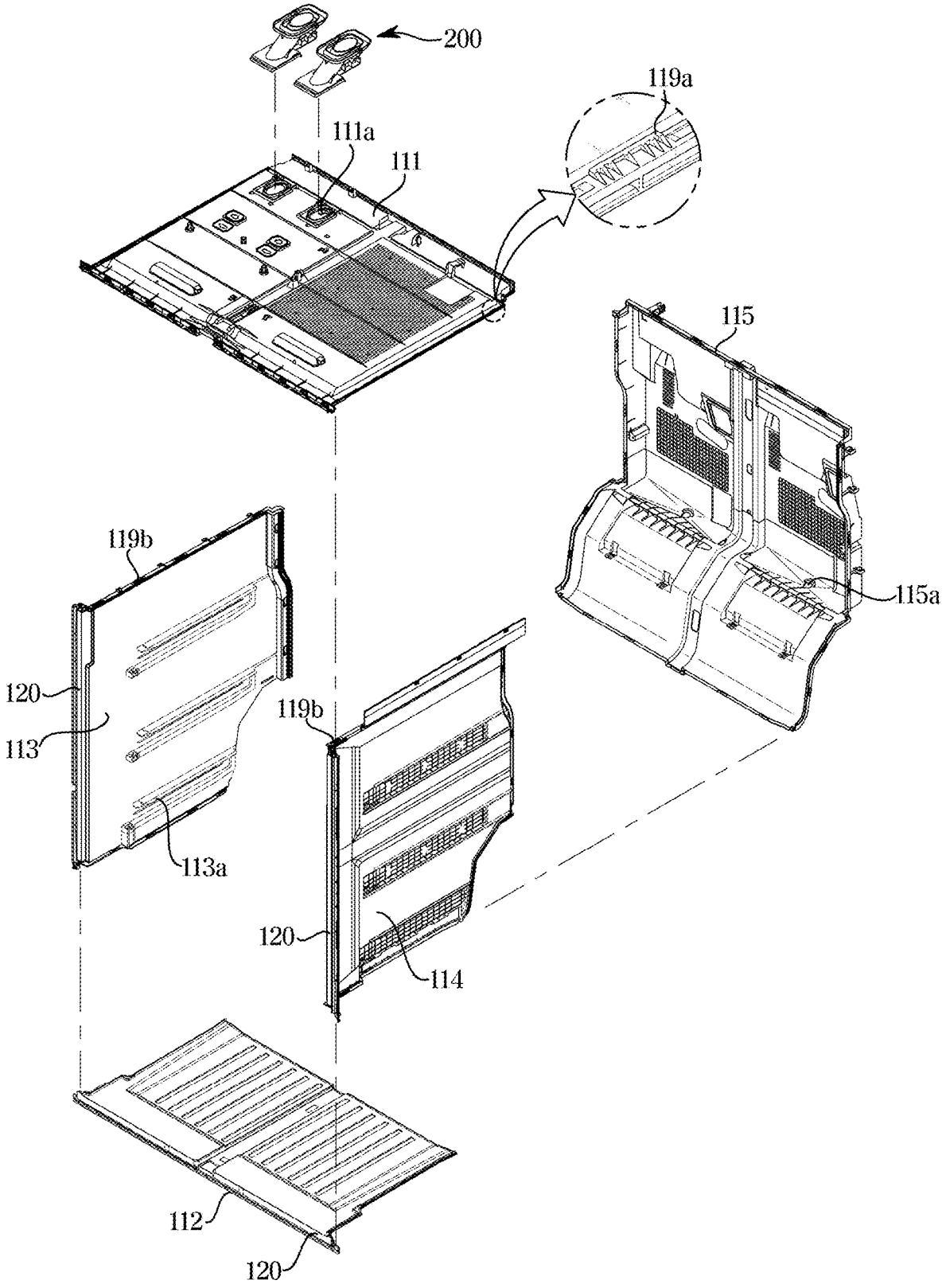
FIG. 6 is a view illustrating a state in which a cold air guide and a second inner case are disassembled in a refrigerator according to an embodiment of the disclosure.

FIG. 5 is a view illustrating a state in which a first inner case is disassembled in a refrigerator according to an embodiment of the disclosure. FIG. 6 is a view illustrating a state in which a cold air guide and a second inner case are disassembled in a refrigerator according to an embodiment of the disclosure.

Referring to FIG. 5 and FIG. 6, the inner case 100 may include the first inner case 100*a* forming the refrigerating compartment 22 positioned above the freezing compartments 23 and 24, and the second inner case 100*b* forming the freezing compartments 23 and 24 positioned below the refrigerating compartment 22. The first inner case 100*a* and the second inner case 100*b* may be coupled by the same coupling structure in which only the shapes are partially different.

Referring FIG. 5, the first inner case 100*a* according to an embodiment may include a plurality of first plates 101, 102, 103, 104, and 105. The first inner case 100*a* may be formed by coupling the plurality of first plates 101, 102, 103, 104, and 105. The plurality of first plates 101, 102, 103, 104, and 105 may be coupled to each other without a separate fastening member. That is, each of the plurality of first plates 101, 102, 103, 104, and 105 may include a coupler integrally formed for mutual coupling.

The plurality of first plates 101, 102, 103, 104, and 105 may be formed of a resin material through an injection molding method. Each of the plurality of first plates 101, 102, 103, 104, and 105 may have four edges. The plurality of first plates 101, 102, 103, 104, and 105 may include a first upper plate 101, a first lower plate 102, a first left plate 103, a first right plate 104, and a first rear plate 105.

The first upper plate 101 may form an upper surface of the storage compartment 22. The first lower plate 102 may form a lower surface of the storage compartment 22. The first left plate 103 may form a left surface of the storage compartment 22. The first right plate 104 may form a right surface of the storage compartment 22. The first rear plate 105 may form a rear surface of the storage compartment 22.

A shape of the first upper plate 101, the first lower plate 102, the first left plate 103, the first right plate 104 and the first rear plate 105 is not limited to a flat shape without a curve. Alternatively, the first upper plate 101, the first lower plate 102, the first left plate 103, the first right plate 104 and the first rear plate 105 may include a curve. Accordingly, the first upper plate 101, the first lower plate 102, the first left plate 103, the first right plate 104 and the first rear plate 105 may have various shapes as long as forming the upper surface, the lower surface, the left surface, the right surface and the rear surface of the storage compartment 22.

In addition, unlike the embodiment, at least two or more first plates adjacent to each other among the first upper plate 101, the first lower plate 102, the first left plate 103, the first right plate 104, and the first rear plate 105 may be integrally formed with each other.

That is, unlike the embodiment, the first inner case 100*a* may be formed of a number of parts less than the five parts corresponding to the first upper plate 101, the first lower plate 102, the first left plate 103, the first right plate 104, and the first rear plate 105.

For example, the first upper plate 101 and the first right plate 104 may be integrally injection molded, and the first lower plate 102 and the first left plate 103 may be integrally injection molded. Alternatively, the first upper plate 101 and the first left plate 103 may be integrally injection molded, and the first lower plate 102 and the first right plate 104 may be integrally injection molded.

Even when the first inner case 100*a* is formed of a number of parts less than the five parts corresponding to the first upper plate 101, the first lower plate 102, the first left plate 103, the first right plate 104, and the first rear plate 105, as described above, descriptions described below may be equally applied.

The first inner case 100*a* may include the first upper plate 101, the first lower plate 102, the first left plate 103, the first right plate 104, and the first rear plate 105. The first upper plate 101, the first lower plate 102, the first left plate 103, the first right plate 104, and the first rear plate 105 may be provided to be separated from each other. The first upper plate 101, the first lower plate 102, the first left plate 103, the first right plate 104, and the first rear plate 105 may be injection molded. The first upper plate 101, the first lower plate 102, the first left plate 103, the first right plate 104, and the first rear plate 105 provided to be separated may be assembled to form the first inner case 100*a*. Because all of the first upper plate 101, the first lower plate 102, the first left plate 103, the first right plate 104, and the first rear plate 105 are injection molded, the first upper plate 101, the first lower plate 102, the first left plate 103, the first right plate 104, and the first rear plate 105 may be molded to have various patterns (not shown) without an additional post-process. Further, the first upper plate 101, the first lower plate 102, the first left plate 103, the first right plate 104, and the first rear plate 105 may be molded to have various colors. That is, the first upper plate 101, the first lower plate 102, the first left plate 103, the first right plate 104, and the first rear plate 105 may have a different pattern or a different color for each purpose of the storage compartment 20. In addition, the first upper plate 101, the first lower plate 102, the first left plate 103, the first right plate 104, and the first rear plate 105 may all have different patterns or different colors. Accordingly, a user may have a wider range of selections for the refrigerator.

A front flange 110 may be integrally formed on the first upper plate 101, the first lower plate 102, the first left plate 103, and the first right plate 104. Because all of the first upper plate 101, the first lower plate 102, the first left plate 103, and the first right plate 104 are injection molded, the front flange 110 covering a front surface of the first inner case 100*a* may be integrally formed with the first upper plate 101, the first lower plate 102, the first left plate 103, and the first right plate 104.

The rotation guide 108 provided to guide the rotating rod 35, which is rotatably coupled to the pair of refrigerating compartment doors 31, to rotate according to the rotation of the refrigerating compartment door 31 may be injection molded integrally with a lower surface of the first upper plate 101. A lamp case 107 in which a light emitting diode LED (L, refer to FIG. 1) may be injection molded integrally with the first left plate 103 and the first right plate 104.

The first left plate 103 and the first right plate 104 may be injection molded integrally with a rail 106 in which the storage container 26 is supported to slidably move.

The first rear plate 105 is injection molded into a thin film to have competitiveness in material cost, and to this end, a plurality of gates (not shown) may be required. The first rear plate 105 may include a drain hole 105*a* provided to drain the condensed water or defrost water falling from the evaporator E.

A plurality of assembly hooks 109*a* or a plurality of assembly holes 109*b* for assembly may be formed on the first upper plate 101, the first lower plate 102, the first left plate 103, the first right plate 104, and the first rear plate 105. The first upper plate 101, the first lower plate 102, the first left plate 103, and the first right plate 104 may be assembled to each other through the remaining three edge surfaces, except for the front of the four edge surfaces. Accordingly, the plurality of assembly hooks 109*a* or the plurality of assembly holes 109*b* may be formed on the remaining three edge surfaces, except for the front flange 110. Further, the plurality of assembly hooks 109*a* or the plurality of assembly holes 109*b* may be formed on all the four edge surfaces of the first rear plate 105. That is, when the assembly of the first upper plate 101 and the first right plate 104 is described as an example, the plurality of assembly hooks 109*a* may be formed on a right surface of the first upper plate 101, and the plurality of assembly holes 109*b* may be formed on an upper surface of the first right plate 104 assembled to the right surface of the first upper plate 101. Although it is shown in the drawing that the plurality of assembly hooks 109*a* are formed on the right surface of the first upper plate 101 and the plurality of assembly holes 109*b* are formed on the upper surface of the first right plate 104, the plurality of assembly holes 109*b* may be formed on the right surface of the first upper plate 101, and the plurality of assembly hooks 109*a* may formed on the upper surface of the first right plate 104. As for the first lower plate 102, the plurality of assembly hooks 109*a* may be formed on the lower side of the three edge surfaces, and thus the plurality of assembly hooks 109*a* may not be shown in the drawing.

Referring FIG. 6, the second inner case 100*b* according to an embodiment may include a plurality of second plates 111, 112, 113, 114, and 115. The second inner case 100*b* may be formed by coupling the plurality of second plates 111, 112, 113, 114, and 115. The plurality of second plates 111, 112, 113, 114, and 115 may be coupled to each other without a separate fastening member. That is, each of the plurality of second plates 111, 112, 113, 114, and 115 may include a coupler integrally formed for mutual coupling.

The plurality of second plates 111, 112, 113, 114, and 115 may be formed of a resin material through an injection molding method. Each of the plurality of second plates 111, 112, 113, 114, and 115 may have four edges. The plurality of second plates 111, 112, 113, 114, and 115 may include a second upper plate 111, a second lower plate 112, a second left plate 113, a second right plate 114, and a second rear plate 115.

The second upper plate 111 may form an upper surface of the storage compartment 22. The second lower plate 112 may form a lower surface of the storage compartment 22. The second left plate 113 may form a left surface of the storage compartment 22. The second right plate 114 may form a right surface of the storage compartment 22. The second rear plate 115 may form a rear surface of the storage compartment 22.

A shape of the second upper plate 111, the second lower plate 112, the second left plate 113, the second right plate 114 and the second rear plate 115 is not limited to a flat shape without a curve. Alternatively, the second upper plate 111, the second lower plate 112, the second left plate 113, the second right plate 114 and the second rear plate 115 may include a curve. Accordingly, the second upper plate 111, the second lower plate 112, the second left plate 113, the second right plate 114 and the second rear plate 115 may have various shapes as long as forming the upper surface, the lower surface, the left surface, the right surface and the rear surface of the storage compartments 23 and 24.

In addition, unlike the embodiment, at least two or more second plates adjacent to each other among the second upper plate 111, the second lower plate 112, the second left plate 113, the second right plate 114 and the second rear plate 115 may be integrally formed with each other.

That is, unlike the embodiment, the second inner case 100*b* may be formed of a number of parts less than the five parts corresponding to the second upper plate 111, the second lower plate 112, the second left plate 113, the second right plate 114 and the second rear plate 115.

For example, the second upper plate 111 and the second right plate 114 may be integrally injection molded, and the second lower plate 112 and the second left plate 113 may be integrally injection molded. Alternatively, the second upper plate 111 and the second left plate 113 may be integrally injection molded, and the second lower plate 112 and the second right plate 114 may be integrally injection molded.

Even when the second inner case 100*b* is formed of a number of parts less than the five parts corresponding to the second upper plate 111, the second lower plate 112, the second left plate 113, the second right plate 114 and the second rear plate 115, as described above, descriptions described below may be equally applied.

The second inner case 100*b* may include the second upper plate 111, the second lower plate 112, the second left plate 113, the second right plate 114 and the second rear plate 115, in the same manner as the first inner case 100*a*. The second upper plate 111, the second lower plate 112, the second left plate 113, the second right plate 114 and the second rear plate 115 may be provided to be separated from each other. The second upper plate 111, the second lower plate 112, the second left plate 113, the second right plate 114 and the second rear plate 115 may be injection molded. The second upper plate 111, the second lower plate 112, the second left plate 113, the second right plate 114 and the second rear plate 115 provided to be separated may be assembled to form the second inner case 100*b*. Because all of the second upper plate 111, the second lower plate 112, the second left plate 113, the second right plate 114 and the second rear plate 115 are injection molded, the second upper plate 111, the second lower plate 112, the second left plate 113, the second right plate 114 and the second rear plate 115 may be molded to have various patterns (not shown) without an additional post-process. Further, the second upper plate 111, the second lower plate 112, the second left plate 113, the second right plate 114 and the second rear plate 115 may be molded to have various colors. That is, the second upper plate 111, the second lower plate 112, the second left plate 113, the second right plate 114 and the second rear plate 115 may have a different pattern or a different color for each purpose of the storage compartment 20. In addition, the second upper plate 111, the second lower plate 112, the second left plate 113, the second right plate 114 and the second rear plate 115 may all have different patterns or different colors. Accordingly, a user may have a wider range of selections for the refrigerator.

A front flange 120 may be integrally formed on the second upper plate 111, the second lower plate 112, the second left plate 113, and the second right plate 114. Because all of the second upper plate 111, the second lower plate 112, the second left plate 113, and the second right plate 114 are injection molded, the front flange 120 covering a front surface of the second inner case 100*b* may be integrally formed with the second upper plate 111, the second lower plate 112, the second left plate 113, and the second right plate 114.

The second left plate 113 and the second right plate 114 may be injection molded integrally with a rail 113*a* (not shown) in which the storage container is supported to slidably move.

The second rear plate 115 is injection molded into a thin film to have competitiveness in material cost, and to this end, a plurality of gates (not shown) may be required. The second rear plate 115 may include a drain hole 115*a* provided to drain the condensed water or defrost water falling from the evaporator E.

According to an embodiment, a plurality of assembly hooks 119*a* or a plurality of assembly holes 119*b* for assembly may be formed on the second upper plate 111, the second lower plate 112, the second left plate 113, the second right plate 114 and the second rear plate 115. The second upper plate 111, the second lower plate 112, the second left plate 113, and the second right plate 114 may be assembled to each other through the remaining three edge surfaces, except for the front of the four edge surfaces. Accordingly, the plurality of assembly hooks 119*a* or the plurality of assembly holes 119*b* may be formed on the remaining three edge surfaces, except for the front flange 120. Further, the plurality of assembly hooks 119*a* or the plurality of assembly holes 119*b* may be formed on all the four edge surfaces of the second rear plate 115. That is, when the assembly of the second upper plate 111 and the second right plate 114 is described as an example, the plurality of assembly hooks 119*a* may be formed on a right surface of the second upper plate 111, and the plurality of assembly holes 119*b* may be formed on an upper surface of the second right plate 114 assembled to the right surface of the second upper plate 111. Although it is shown in the drawing that the plurality of assembly hooks 119*a* are formed on the right surface of the second upper plate 111 and the plurality of assembly holes 119*b* are formed on the upper surface of the second right plate 114, the plurality of assembly holes 119*b* may be formed on the right surface of the second upper plate 111, and the plurality of assembly hooks 119*a* may formed on the upper surface of the second right plate 114. As for the second lower plate 112, the plurality of assembly hooks 119*a* may be formed on the three edge surfaces.

Figure 7:
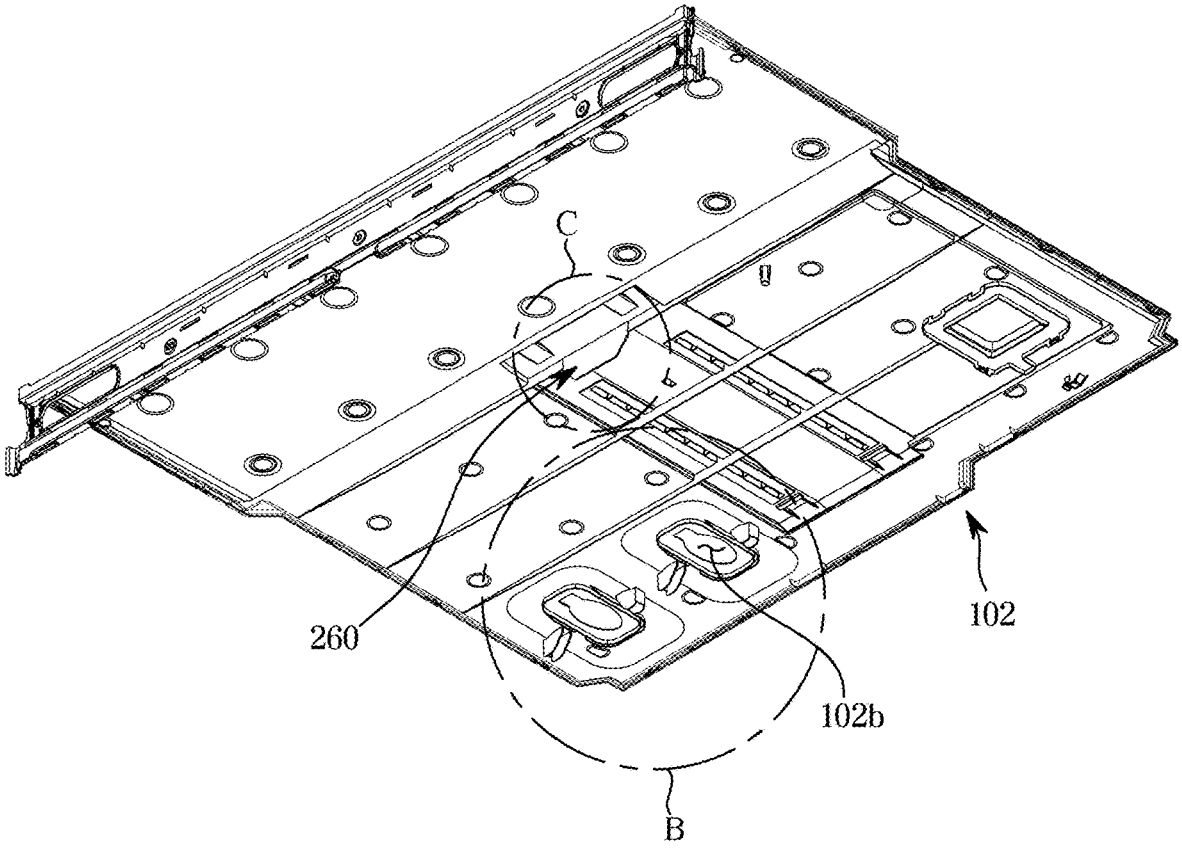
FIG. 7 is a view illustrating a first lower plate of FIG. 5 from another angle.
Figure 8:
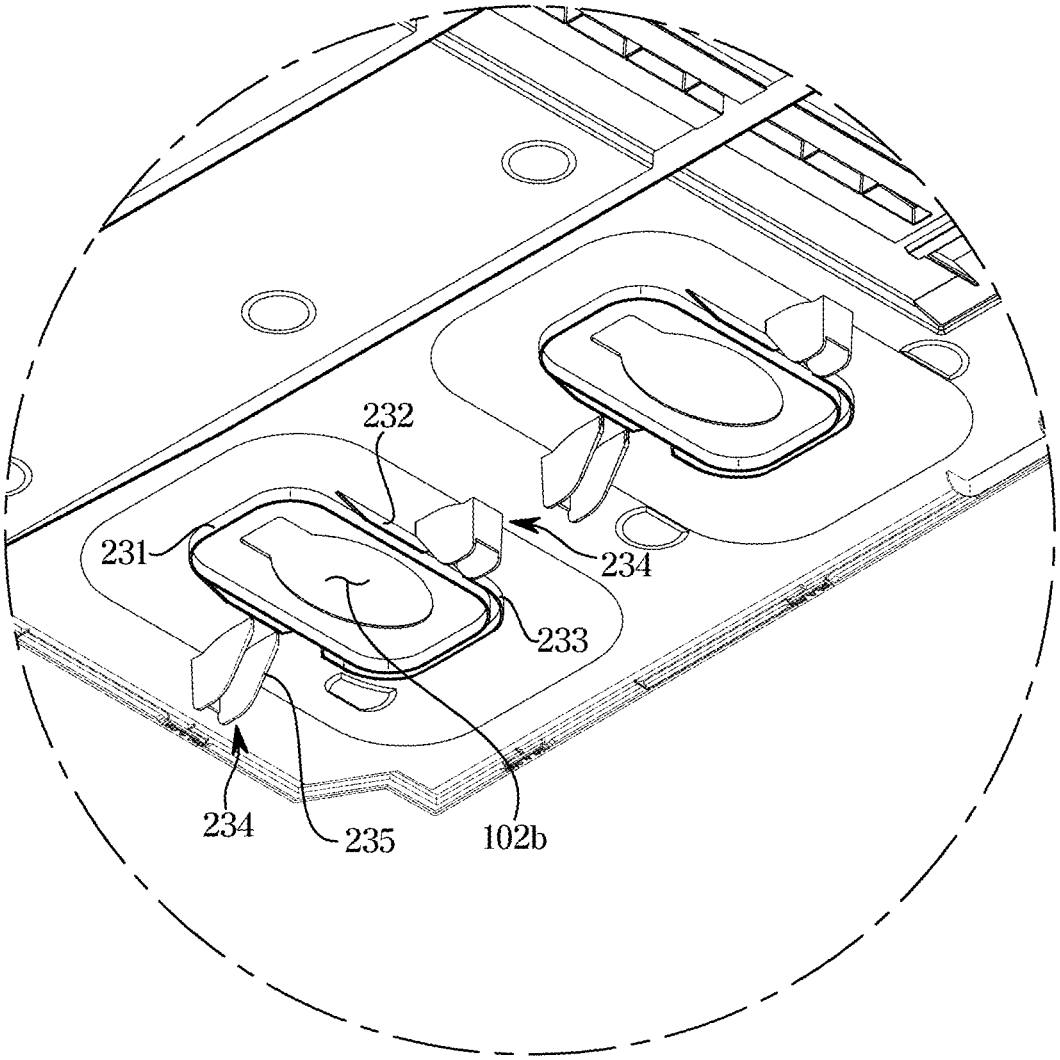
FIG. 8 is an enlarged view illustrating a part B of FIG. 7.

FIG. 7 is a view illustrating a first lower plate of FIG. 5 from another angle. FIG. 8 is an enlarged view illustrating a part B of FIG. 7.

Referring to FIG. 7 and FIG. 8, the first lower plate 102 may include a first hole 102*b* formed through the first lower plate 102. According to an embodiment of the disclosure, a pair of first holes 102*b* may be provided parallel to each other in a lateral direction, without being limited thereto. One or three or more first holes 102*b* may be provided.

The first lower plate 102 may include the first support protrusion 260 protruding downward from a lower surface of the first lower plate 102. The first support protrusion 260 may be injection molded integrally with the first lower plate 102. The first support protrusion 260 may contact the second support protrusion 270 of the second upper plate 111 to maintain a gap between the first inner case 100*a* and the second inner case 100*b*, which will be described later.

The first lower plate 102 may include a first sealing rib 231 formed along a circumference of the first hole 102*b*. The first sealing rib 231 may protrude downward from the first lower plate 102. The first sealing rib 231 may form a closed loop.

The first lower plate 102 may further include a first auxiliary rib 232 and a second auxiliary rib 233 provided outside the first sealing rib 231. The first auxiliary rib 232 may be disposed on both sides of the first sealing rib 231, and the second auxiliary rib 233 may be disposed on a rear side of the first sealing rib 231. The first auxiliary ribs 232 and the second auxiliary rib 233 may not be connected to each other.

The first lower plate 102 may further include a guide 234 for guiding the cold air guide 200. The guide 234 may include a guide surface 235 contacting the cold air guide 200 to guide the cold air guide 200. The guide surface 235 may be inclined toward the first hole 102*b*. One end of the guide surface 235 may be spaced apart from the first hole 102*b* by a first distance in the vertical direction and the horizontal direction, and the other end of the guide surface 235 may be spaced from the first hole 102*b* by a second distance that is smaller than the first distance in the vertical direction and the horizontal direction. With the structure, even when the cold air guide 200 is assembled to the first lower plate 102 in a position slightly spaced apart from a right position, the cold air guide 200 may be guided to the right position by moving along the guide surface 235. The assembly of the first inner case 100*a*, the cold air guide 200, and the second inner case 100*b* may be facilitated.

A pair of guides 234 may be provided. According to an embodiment of the disclosure, the pair of guides 234 may be disposed on both sides of the first sealing rib 231. By the pair of guides 234 being disposed on both sides of the first sealing rib 231, even when the cold air guide 200 is assembled to the first lower plate 102 in a position slightly spaced apart from the right position in the left-right direction, the cold air guide 200 may be guided to the right position by moving along the guide surface 235. The pair of guides 234 may guide the cold air guide 200 in the left-right direction.

In contrast, the pair of guides 234 may be disposed on the front and rear sides of the first sealing rib 231, and may guide the cold air guide 200 in the front-rear direction. Alternatively, four guides 234 may be disposed on front, rear, left, and right sides of the first sealing rib 231 to guide the cold air guide 200 in the front-rear and left-right directions.

Figure 9:
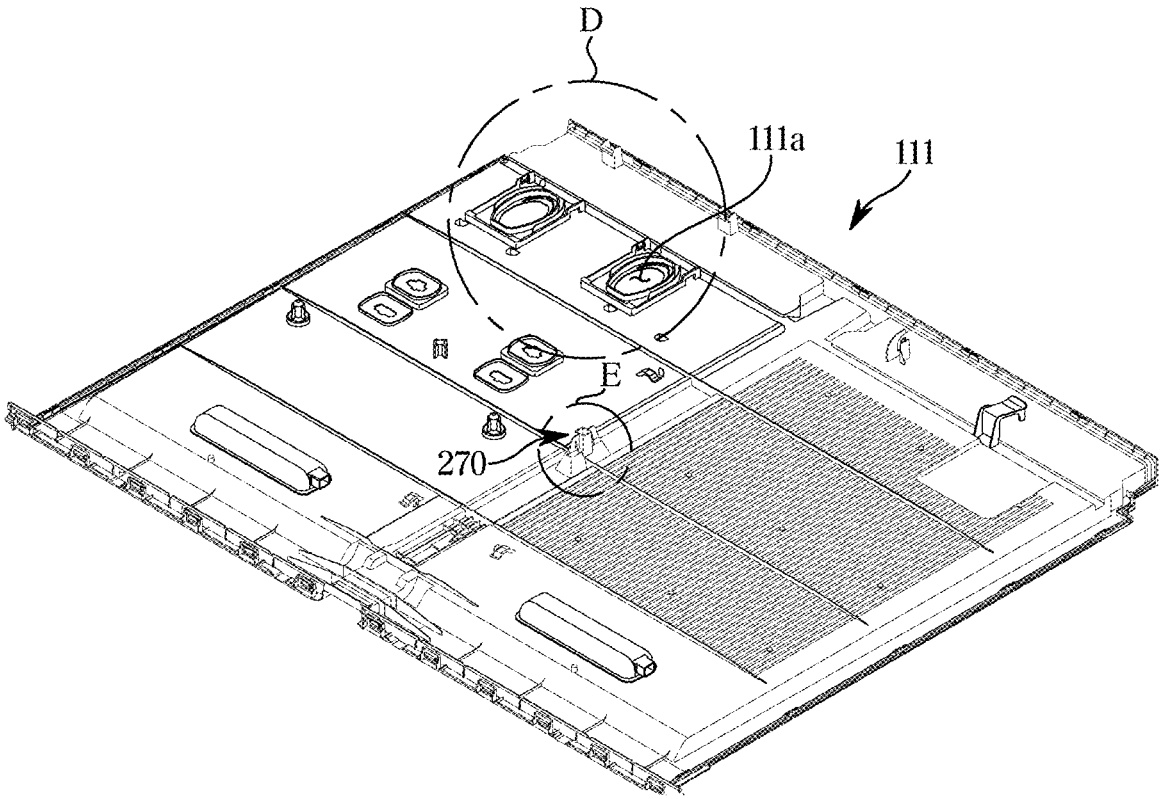
FIG. 9 is a view illustrating a second upper plate of FIG. 6.
Figure 10:
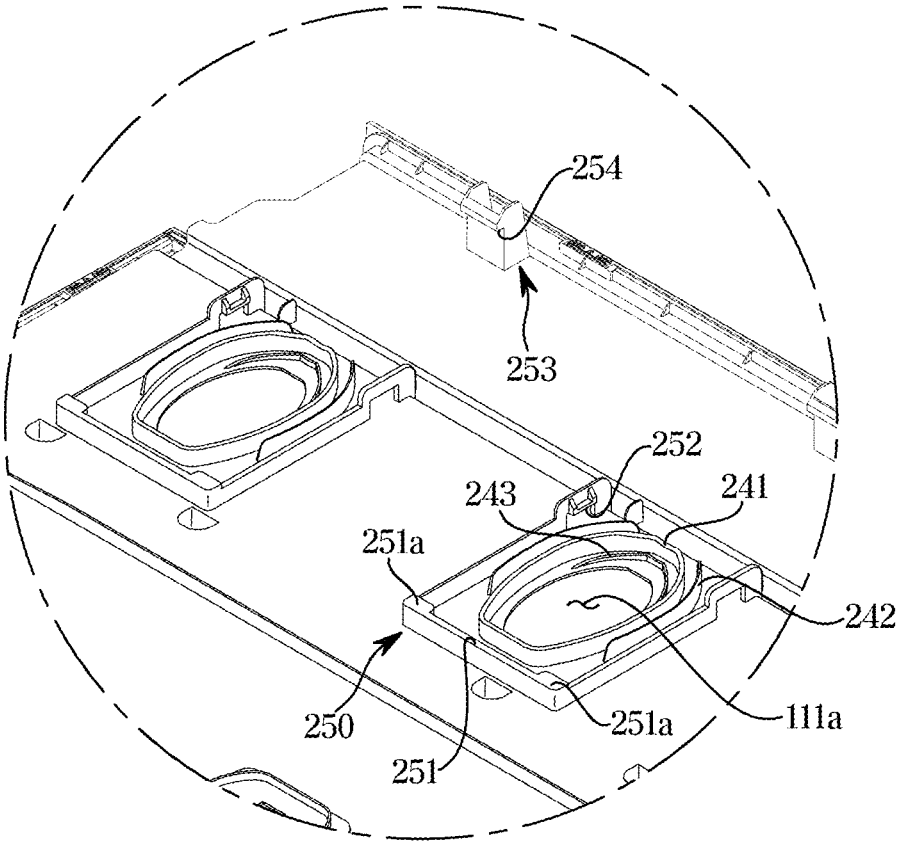
FIG. 10 is an enlarged view illustrating a part D of FIG. 9.

FIG. 9 is a view illustrating a second upper plate of FIG. 6. FIG. 10 is an enlarged view illustrating a part D of FIG. 9.

Referring to FIG. 9, the second upper plate 111 may include a second hole 111*a* formed through the second upper plate 111. The number and positions of the second holes 111*a* may correspond to the number and positions of the first holes 102*b*.

The second upper plate 111 may include a second sealing rib 241 formed along a circumference of the second hole 111*a* and protruding upward from the second upper plate 111. The second sealing rib 241 may form a closed loop.

The second upper plate 111 may further include a third auxiliary rib 242 provided outside the second sealing rib 241 and a fourth auxiliary rib 243 provided inside the second sealing rib 241. The third auxiliary rib 242 may be disposed on both sides of the second sealing rib 241. The fourth auxiliary rib 243 may be disposed at the rear of the second hole 111*a*, between the second sealing rib 241 and the second hole 111*a*.

The second upper plate 111 may include a flange coupler 250 for coupling a second flange 220 of the cold air guide 200. The second flange 220 may be coupled to the flange coupler 250 without a separate fastening member.

Figure 12:
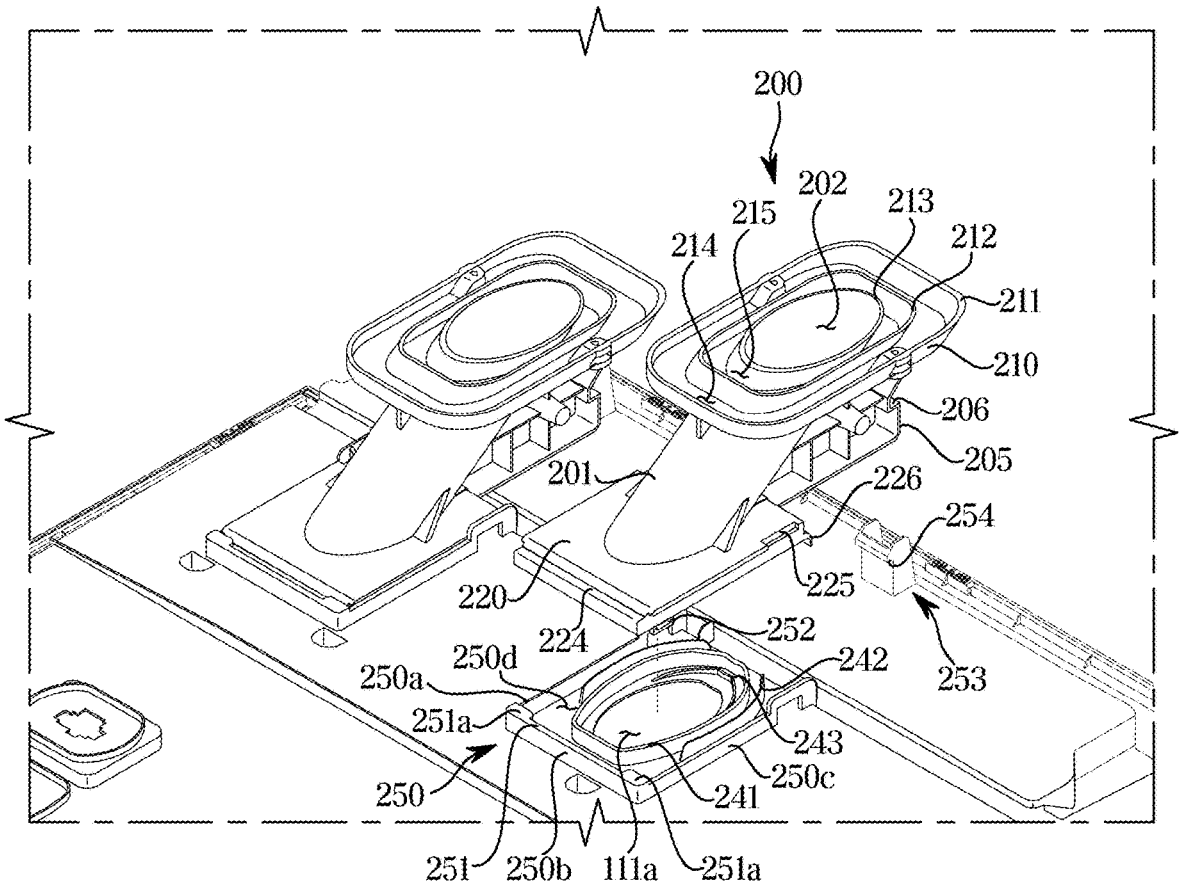
FIG. 12 is a view illustrating a cold air guide and a second upper plate in a refrigerator according to an embodiment of the disclosure.

The flange coupler 250 may include coupling ribs 250*a*, 250*b*, and 250*c* (see FIG. 12) forming a flange coupling groove (250*d*, see FIG. 12).

The coupling ribs 250*a*, 250*b*, and 250*c* may include the first coupling rib 250*a* disposed in front of the first hole 102*b* and second coupling ribs 250*b* and 250*c* disposed at both sides.

The first coupling rib 250*a* may include covers 251 inserted into a first recess 224 of the cold air guide 200.

The second coupling ribs 250*b* and 250*c* may include a coupling protrusion 252 coupled to a second recess 225 of the cold air guide 200.

In addition, the flange coupler 250 may further include a fixing protrusion 253 coupled to a reinforcement 205 of the cold air guide 200 to fix the flange coupler 250.

Figure 11:
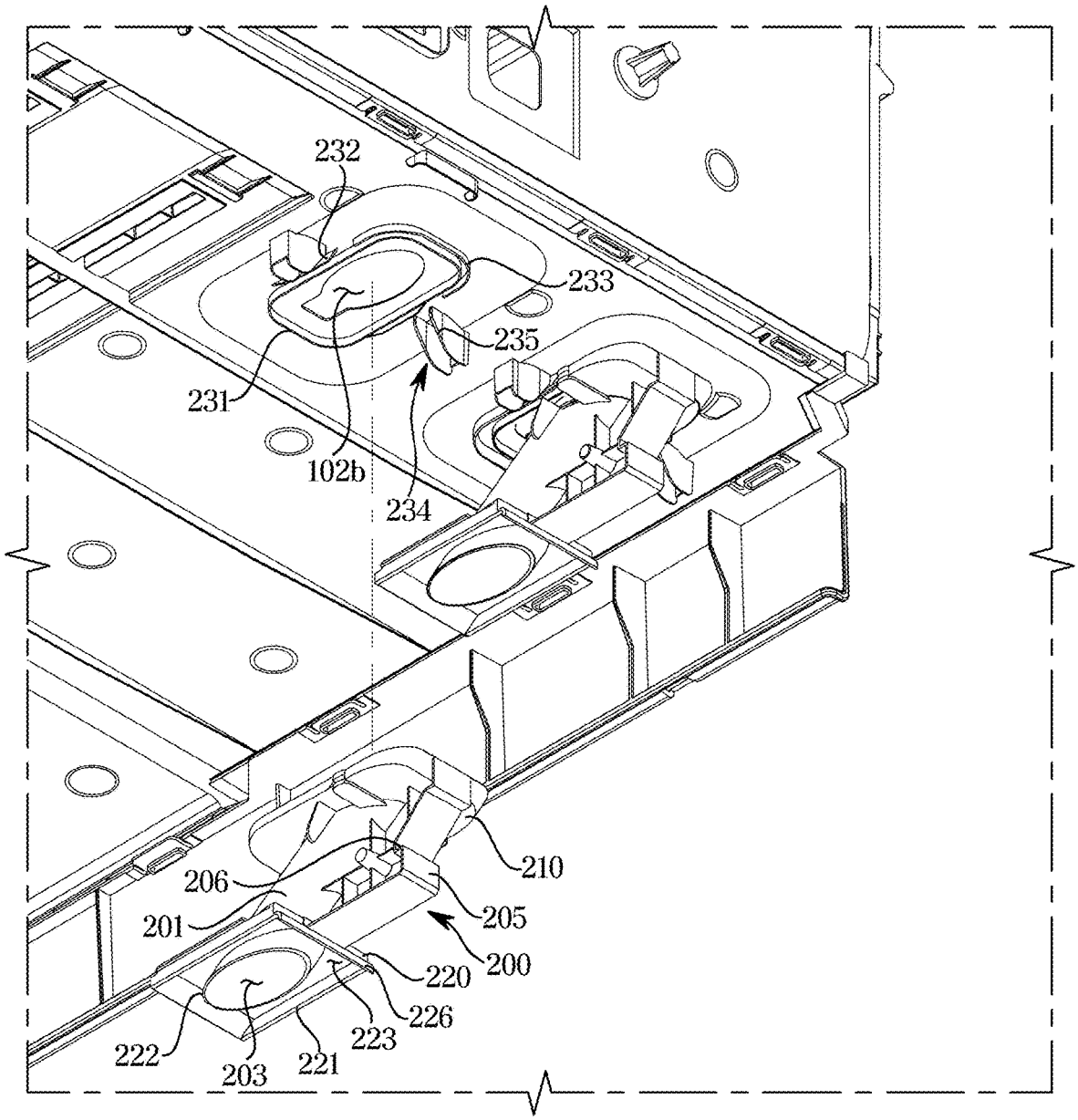
FIG. 11 is a view illustrating a cold air guide and a first lower plate in a refrigerator according to an embodiment of the disclosure.

FIG. 11 is a view illustrating a cold air guide and a first lower plate in a refrigerator according to an embodiment of the disclosure. FIG. 12 is a view illustrating a cold air guide and a second upper plate in a refrigerator according to an embodiment of the disclosure.

Hereinafter, referring to FIG. 11 and FIG. 12, a coupling structure of the cold air guide 200 and the first lower plate 102 and a coupling structure of the cold air guide 200 and the second upper plate 111 are described.

The cold air guide 200 may be provided to form the cold air flow path 204 (see FIG. 2) by connecting the first hole 102*b* of the first lower plate 102 and the second hole 111*a* of the second upper plate 111. The cold air guide 200 may be provided separately from the first inner case 100*a* and the second inner case 100*b*. The cold air guide 200 may be disposed between the first lower plate 102 and the second upper plate 111 to form the cold air flow path 204 and to maintain a distance between the first lower plate 102 and the second upper plate 111. That is, the cold air guide 200 may also serve as a support member.

The cold air guide 200 may be first coupled to the second upper plate 111, and then coupled to the first lower plate 102. For convenience of description, the coupling structure between the cold air guide 200 and the first lower plate 102 is described first.

Referring to FIG. 11 and FIG. 12, the cold air guide 200 may include a body 201 forming the cold air flow path 204, the first flange 210 provided at an upper end of the body 201, and the second flange 220 provided at a lower end of the body 201.

The body 201 may be provided in an inclined cylindrical shape to form the cold air flow path 204. A first opening 202 connected to the first hole 102*b* may be provided at one end of the cold air flow path 204. A second opening 203 connected to the second hole 111*a* may be provided at the other end of the cold air flow path 204. The body 201 may include one end 213 forming the first opening 202 and another end 222 forming the second opening 203.

The body 201 may be inclined. For example, the body 201 may be inclined such that a lower end is positioned forward and an upper end is positioned rearward. However, the body 201 is not limited thereto. The inclined direction of the body 201 may be changed, and alternatively, the body 201 may be provided vertically. The reinforcement 205 may be provided at the rear of the body 201. The reinforcement 205 may be provided to prevent the cold air guide 200 from being damaged when the cold air guide 200 receives a force in the vertical direction. The reinforcement 205 may be provided in order for the cold air guide 200 to withstand external forces applied to the cold air guide 200 in the vertical direction. The reinforcement 205 may include a first locking surface 206. The first locking surface 206 may be elastically coupled to a second locking surface 254 of the fixing protrusion 253 to be described later.

The first flange 210 may include a first flange rib 212 formed outside of one end 213 of the body 201, and a second flange rib 211 formed outside of the first flange rib 212. Each of the first flange rib 212 and the second flange rib 211 may form a closed loop. A first sealing groove 215 may be formed between the one end 213 of the body 201 and the first flange rib 212. A second sealing groove 214 may be formed between the first flange rib 212 and the second flange rib 211.

The second flange 220 may include a third flange rib 221 formed outside of the other end 222 of the body 201. The third flange rib 221 may form a closed loop. A third sealing groove 223 may be formed between the other end 222 of the body 201 and the third flange rib 221.

The second flange 220 may include the first recess 224 covered by the cover 251 of the flange coupler 250, and the second recess 225 coupled to the coupling protrusion 252 of the flange coupler 250. In addition, the second flange 220 may further include an extension rib 226 extending downward from a rear end of the second flange rib 221.

The first recess 224 may be formed by recessing a portion of a front end of the second flange 220 downward. Because the first recess 224 is covered by the cover 251, the front end of the second flange 220 may be fixed to the flange coupler 250.

The second recesses 225 may be disposed on both sides of the second flange 220. More specifically, the second recesses 225 may be disposed adjacent to a rear end of the second flange 220 on both sides of the second flange 220. The coupling protrusion 252 to be described later may be coupled to the second recess 225. The second recess 225 is fixed by the coupling protrusion 252, thereby fixing a rear portion of the second flange 220 to the flange coupler 250.

The extension rib 226 may be provided in a curved shape to correspond to a shape of the second upper plate 111. The extension rib 226 is provided to correspond to the shape of the second upper plate 111, thereby preventing the insulation 150 from being introduced between the extension rib 226 and the second upper plate 111.

Referring to FIG. 11, the cold air guide 200 may be coupled to the first lower plate 102. Specifically, the first flange 210, provided at the upper end of the cold air guide 200, may be coupled to the first lower plate 102 to cover the first hole 102*b* that is formed in the first lower plate 102, the first sealing rib 231, the first auxiliary rib 232 and the second auxiliary rib 233.

When the cold air guide 200 is coupled to the first lower plate 102, the guide 234 may guide the cold air guide 200 to allow the cold air guide 200 to be positioned in a right position. The right position of the cold air guide 200 may refer to a position where the cold air guide 200 is coupled to the first lower plate 102 to cover the first hole 102*b*, the first sealing rib 231, the first auxiliary rib 232, and the second auxiliary rib 233. More specifically, the right position of the cold air guide 200 may refer to a position where the lower end of the first sealing rib 231 contacts the first flange 210 to prevent the insulation 150 from flowing into the first flange 210.

When the cold air guide 200 is coupled to the first lower plate 102, the cold air guide 200 may contact the guide 234. When the cold air guide 200 moves toward the first lower plate 102 or the first lower plate 102 moves toward the cold air guide 200, the cold air guide 200 may move along the guide surface 235 of the guide 234. The cold air guide 200 may be guided to the above-described right position by moving along the guide surface 235. When the cold air guide 200 moves upward toward the first lower plate 102 or the first lower plate 102 moves downward toward the cold air guide 200, the first flange 210 of the cold air guide 200 may be guided to the above-described right position by moving along the guide surface 235 of the guide 234.

When the first flange 210 is coupled to the first lower plate 102 in the right position, the insulation 150 may be prevented from being introduced between the first flange 210 and the first lower plate 102. The first flange 210 and the first lower plate 102 may be coupled to be sealed. The insulation 150 may be prevented from flowing through the first flange 210 and the first lower plate 102 into the cold air flow path 204.

Referring to FIG. 12, the cold air guide 200 may be coupled to the second upper plate 111. Specifically, the second flange 220, provided at the lower end of the cold air guide 200, may be coupled to the second upper plate 111 to cover the second hole 111*a* that is formed in the second upper plate 111, the second sealing rib 241, the third auxiliary rib 242 and the fourth auxiliary rib 243.

The cold air guide 200 may be coupled to the second upper plate 111 by coupling the second flange 220 to the flange coupler 250 provided in the second upper plate 111.

The second flange 220 may be inserted into the flange coupling groove 250*d*. The coupling ribs 250*a*, 250*b*, and 250*c* may contact a side surface of the second flange 220. The second flange 220 may be restricted from moving left and right or forward by contacting the coupling ribs 250*a*, 250*b*, and 250*c* with the side surface of the second flange 220.

The first recess 224 provided at a front end of the second flange 220 may be covered by the cover 251 of the first coupling rib 250*a*, thereby fixing the front end of the second flange 220 to the flange coupler 250.

The cover 251 may include extensions 251*a* at both side ends of the cover 251. The extensions 251*a* may have larger area than the cover 251. The extensions 251*a* may have a relatively large contact area with the first recess 224 to more stably fix the second flange 220.

The coupling protrusion 252 provided in the second coupling ribs 250*b* and 250*c* may be coupled to the second recesses 225 provided at both ends of the second flange 220. When a rear end of the cold air guide 200 rotates downward in a state where the first recess 224 is fixed by the cover 251, the coupling protrusion 252 may be elastically coupled to the second recess 225. After the coupling protrusion 252 is elastically deformed, the coupling protrusion 252 may be coupled to the second recess 225.

In addition, the fixing protrusion 253 disposed at the rear of the coupling ribs 250*a*, 250*b*, and 250*c* may be coupled to the reinforcement 205 of the cold air guide 200. Specifically, the first locking surface 206 of the reinforcement 205 and the second locking surface 254 of the fixing protrusion 253 contact each other, and thus the reinforcement 205 may be fixed by the fixing protrusion 253. The reinforcement 205 is fixed by the fixing protrusion 253, thereby fixing a rear portion of the cold air guide 200 to the second upper plate 111. In addition, rearward movement of the cold air guide 200 may be restricted by the fixing protrusion 253.

When the second flange 220 is coupled to the flange coupler 250, the insulation 150 may be prevented from being introduced between the second flange 220 and the second upper plate 111. The second flange 220 and the second upper plate 111 may be coupled to be sealed. The insulation 150 may be prevented from flowing through the second flange 220 and the second upper plate 111 into the cold air flow path 204.

Figure 13:
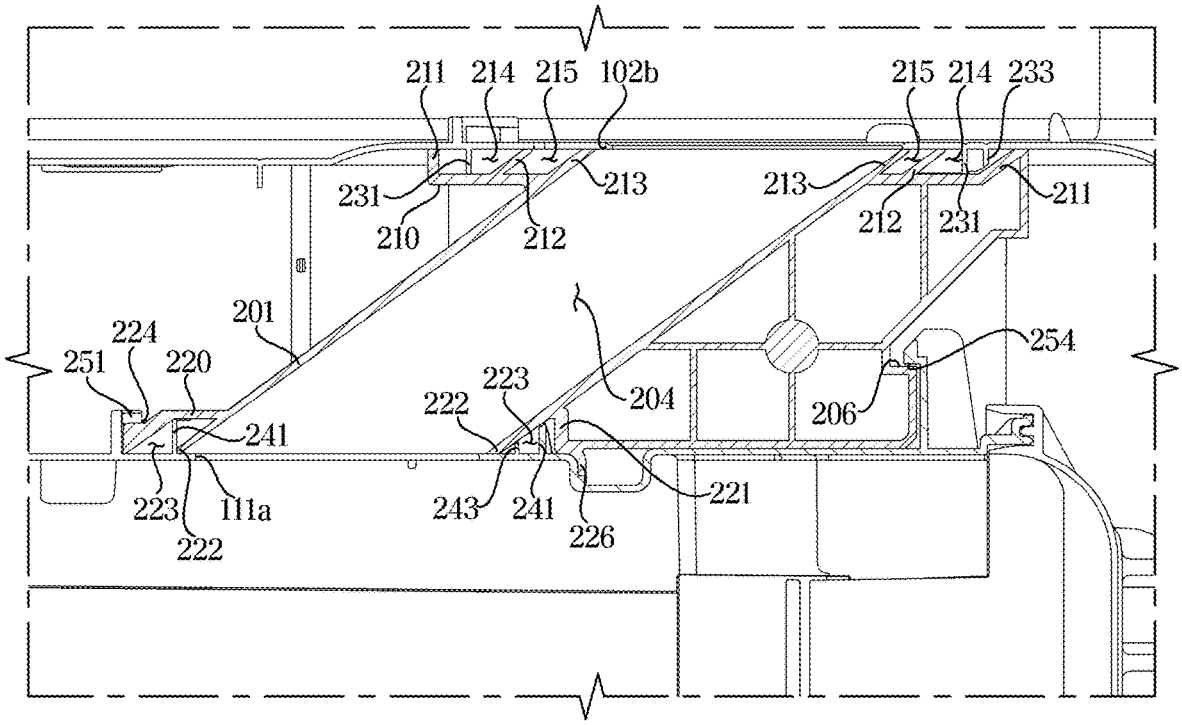
FIG. 13 is an enlarged view illustrating a portion of a cross section taken along line A-A' of FIG. 4.

FIG. 13 is an enlarged view illustrating a portion of a cross section taken along line A-A' of FIG. 4.

Hereinafter, sealing between the cold air guide 200 and the first lower plate 102 and sealing between the cold air guide 200 and the second upper plate 111 are described with reference to FIG. 13.

Referring to FIG. 13, a plurality of partition walls may exist between the cold air guide 200 and the first lower plate 102 to prevent inflow of the insulation 150.

Between a front end of the first flange 210 and a front end of the first hole 102*b*, the second flange rib 211, the first sealing rib 231, the first flange rib 212, and one end 213 of the body 201 may be provided. In other words, the first sealing rib 231 may be provided inside the second sealing groove 214.

In order for the insulation 150 to flow from the front of the first flange 210 into the first opening 202 that is one end of the cold air flow path 204, the insulation 150 is required to pass the second flange rib 211, the first sealing rib 231, the first flange rib 212 and the one end 213 of the body 201. The second flange rib 211, the first flange rib 212, and the one end 213 of the body 201 may contact the first lower plate 102. The first sealing rib 231 may contact the second flange 220. Ends of the plurality of ribs 211, 231, 212 and 213 contact the first lower plate 102 or the second flange 220 to prevent passage of the insulation 150. Even though the insulation 150 passes through some of the plurality of ribs 211, 231, 212, and 213, the insulation 150 is incapable of flowing into the cold air flow path 204 through all of the ribs 211, 231, 212, and 213. Accordingly, the insulation 150 foamed between the first inner case 100*a* and the second inner case 100*b* may be prevented from flowing into the cold air flow path 204.

In order for the insulation 150 to flow from the rear of the first flange 210 into the first opening 202 that is one end of the cold air flow path 204, the insulation 150 is required to pass the second flange rib 211, the second auxiliary rib 233, the first sealing rib 231, the first flange rib 212, and the one end 213 of the body 201. Because the second auxiliary rib 233 is added to the rear of the first flange 210 compared to the front of the first flange 210, inflow of the insulation 150 may be blocked more effectively.

In order for the insulation 150 to flow from a front of the second flange 220 into the second opening 203 that is the other end of the cold air flow path 204, the insulation 150 is required to pass the first coupling rib 250*a*, the cover 251, the third flange rib 221, the second sealing rib 241, and the other end 222 of the body 201. The first coupling rib 250*a* may extend from the second upper plate 111, the third flange rib 221 may contact the second upper plate 111, the second sealing rib 241 may contact the second flange 220, and the other end 222 of the body 201 may contact the second upper plate 111. The plurality of ribs 250*a*, 251, 221, 241, and 222 are in contact with the second upper plate 111 or the second flange 220, thereby preventing the insulation 150 from passing the plurality of ribs 250*a*, 251, 221, 241, and 222. Accordingly, the insulation 150 foamed between the first inner case 100*a* and the second inner case 100*b* may be prevented from flowing into the cold air flow path 204.

At a rear of the second flange 220, the extension rib 226, the third flange rib 221, the second sealing rib 241, the fourth auxiliary rib 243, and the other end 222 of the body 201 may be provided. Similarly to the front of the second flange 220 described above, the plurality of ribs 226, 221, 241, 243, and 222 are provided at the rear of the second flange 220, thereby preventing the insulation 150 from flowing into the cold air flow path 204.

With the above-described structure, when the cold air guide 200 is coupled to the first lower plate 102 and the second upper plate 111, the insulation 150 foamed between the first inner case 100*a* and the second inner case 100*b* may be prevented from flowing into the cold air flow path 204. In other words, a gap between the cold air guide 200 and the first lower plate 102 may be sealed, and a gap between the cold air guide 200 and the second upper plate 111 may be sealed.

According to an aspect of the disclosure, without a separate partition member between the first inner case 100*a* and the second inner case 100*b*, a gap between the first inner case 100*a* and the second inner case 100*b* may be maintained by the first support protrusion 260 and the second support protrusion 270 to be described later. In addition, the first inner case 100*a* and the second inner case 100*b* may be connected by including the cold air guide 200 without a partition member. In a case where a separate partition member is provided between the first inner case 100*a* and the second inner case 100*b*, storage costs, logistics costs, and production costs may increase. According to an aspect of the disclosure, by removing the partition member, storage costs, logistics costs, and production costs of the partition member may be reduced, and thus the productivity of the refrigerator may be improved.

Figure 14:
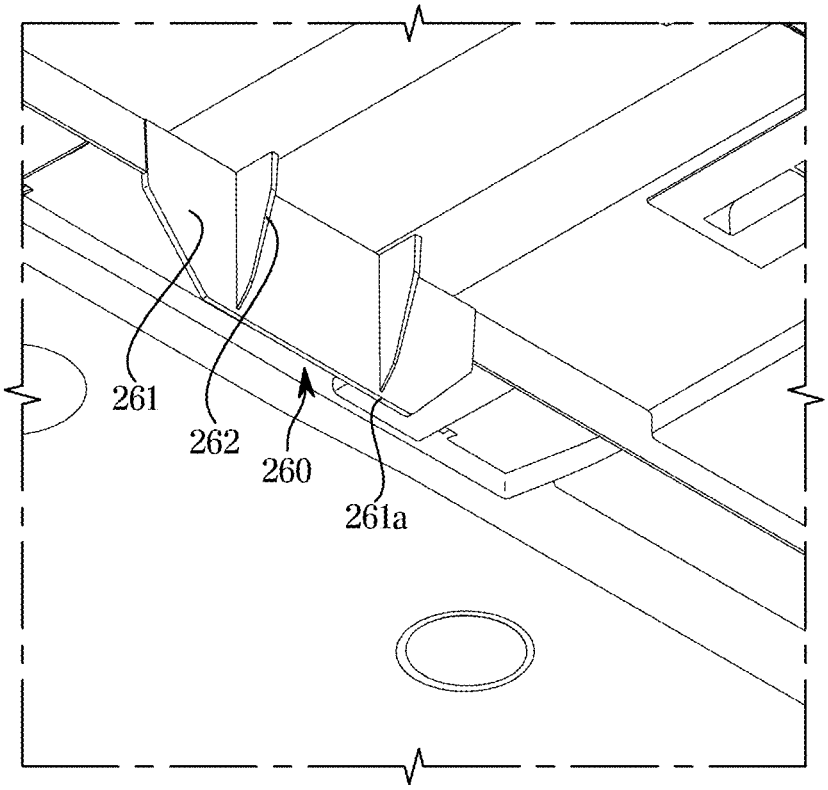
FIG. 14 is a view illustrating a part C of FIG. 7 from another angle.
Figure 15:
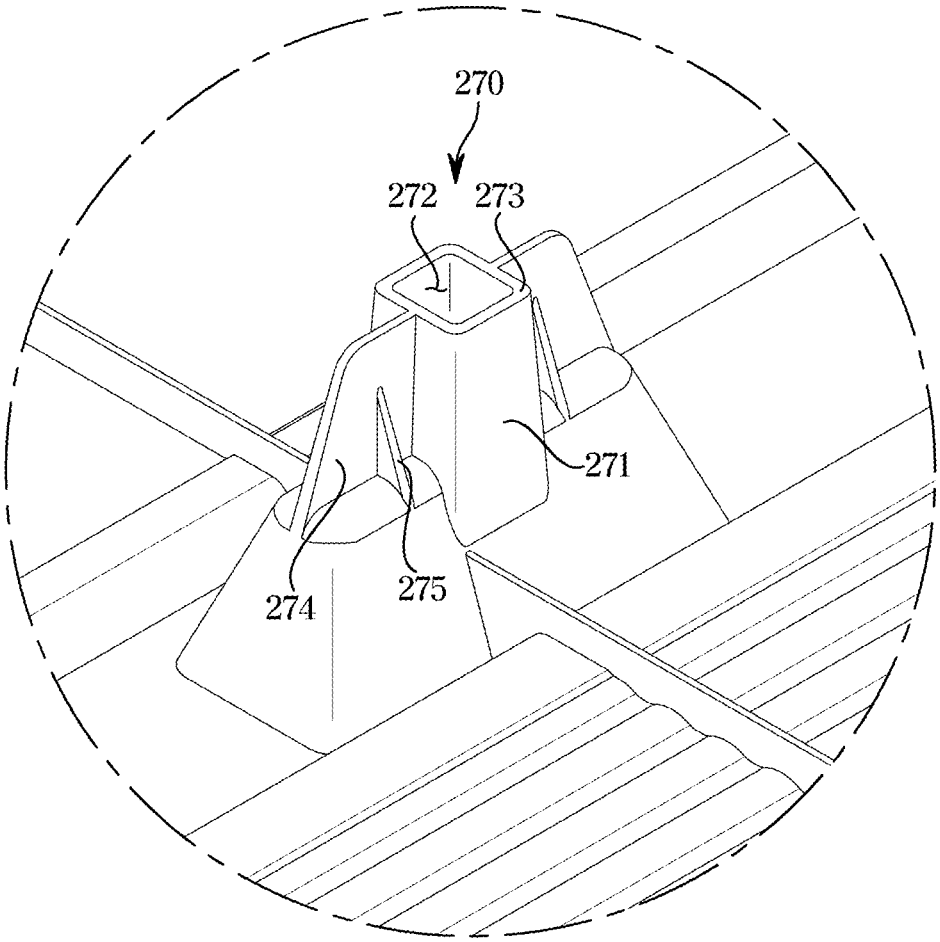
FIG. 15 is an enlarged view illustrating a part E of FIG. 9.
Figure 16:
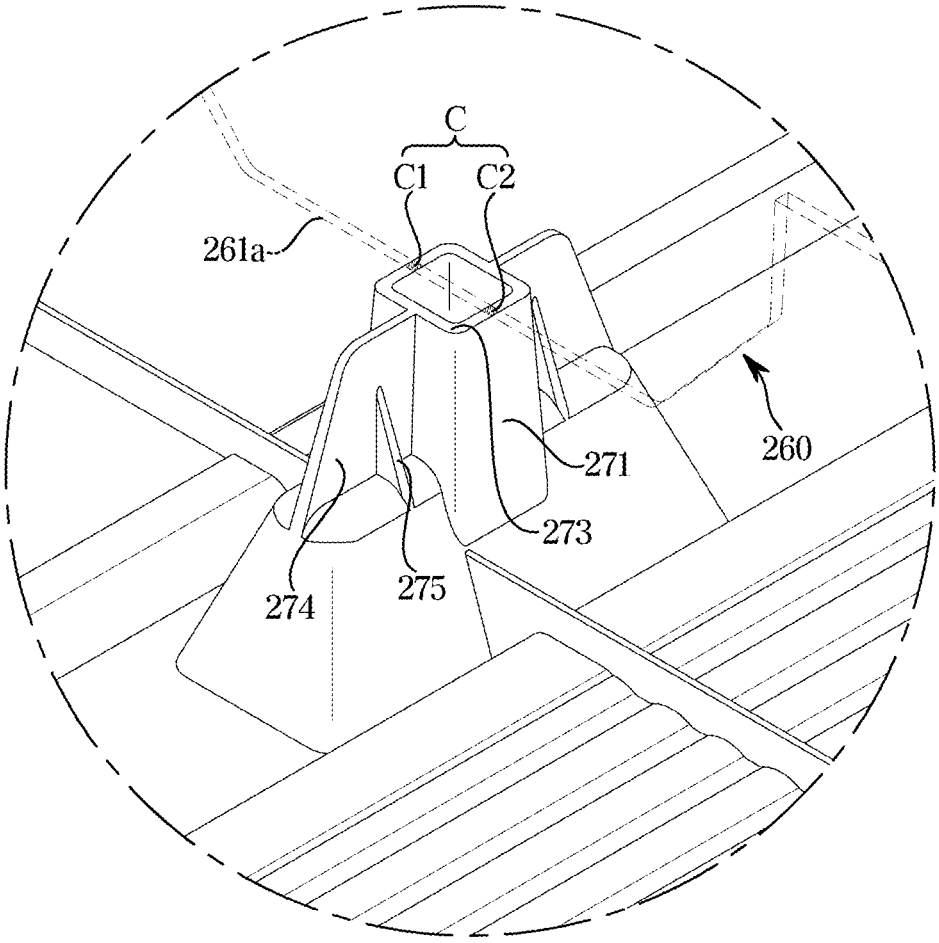
FIG. 16 is a view illustrating a contact surface of a first support protrusion and a second support protrusion in a refrigerator according to an embodiment of the disclosure.

FIG. 14 is a view illustrating a part C of FIG. 7 from another angle. FIG. 15 is an enlarged view illustrating a part E of FIG. 9. FIG. 16 is a view illustrating a contact surface of a first support protrusion and a second support protrusion in a refrigerator according to an embodiment of the disclosure.

Hereinafter, the first support protrusion 260 and the second support protrusion 270 are described with reference to FIG. 14 to FIG. 16.

Referring to FIG. 14, the first lower plate 102 may include the first support protrusion 260 protruding downward from the first lower plate 102.

The first support protrusion 260 may be injection molded integrally with the first lower plate 102. The first support protrusion 260 may be disposed at a center of the first lower plate 102. The first support protrusion 260 may be provided in a form of a thin rib. The first support protrusion 260 may include a first reinforcing rib 261 to reinforce a weak strength due to the thin thickness. A lower surface 261*a* of the first support protrusion 260 may have a thin width to reduce a contact area with the second support protrusion 270.

Referring to FIG. 15, the second upper plate 111 may include the second support protrusion 270 protruding upward from the second upper plate 111.

The second support protrusion 270 may be injection molded integrally with the second upper plate 111. The second support protrusion 270 may be disposed at a center of the second upper plate 111 to correspond to the first support protrusion 260. The second support protrusion 270 may include a protruding portion 271 with a hole 272 formed in the center, and a pair of second reinforcing ribs 274 provided on both sides of the protruding portion 271. Each of the pair of second reinforcing ribs 274 may include a third reinforcing rib 275 to reinforce a strength of the second reinforcing rib 274.

The protruding portion 271 may include the hole 272 in the center to enable stable contact with the first support protrusion 260 while reducing a contact area with the first support protrusion 260. An upper surface 273 of the protruding portion 271 may have substantially the same thickness as the lower surface 261*a* of the first support protrusion 260.

Referring to FIG. 16, the first support protrusion 260 and the second support protrusion 270 may contact each other at two points C1 and C2 that are spaced apart from each other. A sum C of contact areas at the two points C1 and C2 spaced apart from each other may be significantly small due to the thin thickness of the lower surface 261*a* of the first support protrusion and the thin thickness of the upper surface 273 of the protruding portion.

According to an aspect of the disclosure, the second support protrusion 270 formed integrally with the second upper plate 111 may contact and support the first support protrusion 260 formed integrally with the first lower plate 102, thereby maintaining a gap between the first inner case 100*a* and the second inner case 100*b*. In addition, by minimizing the contact area C between the first support protrusion 260 and the second support protrusion 270, temperature transition occurring between the first inner case 100*a* and the second inner case 100*b*, which have different internal temperatures, may be minimized.

Conventionally, a gap between an upper inner case and a lower inner case was maintained by arranging a separate partition member between the upper inner case and the lower inner case. However, in this case, storage and logistics costs were high due to the large volume of the partition member. In addition, production costs were high due to complex structure of the partition member, which reduced the productivity of the refrigerator.

According to an aspect of the disclosure, without a separate partition member, the gap between the first inner case 100*a* and the second inner case 100*b* may be maintained only by the first support protrusion 260 of the first lower plate 102 constituting the first inner case 100*a* and the second support protrusion 270 of the second upper plate 111 constituting the second inner case 100*b*. Accordingly, the partition member may be removed, and the increase in storage costs, logistics costs, and production costs due to the partition member may be reduced, thereby improving the productivity of the refrigerator 1.

Although the disclosure has been shown and described in relation to specific embodiments, it would be appreciated by those skilled in the art that changes and modifications may be made in these embodiments without departing from the principles and scope of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator, comprising:

a first inner case forming a first storage compartment and comprising a plurality of first plates each formed by injection molding;

a second inner case forming a second storage compartment and comprising a plurality of second plates each formed by injection molding;

an outer case coupled to an outer side of the first inner case and an outer side of the second inner case to form an exterior of the refrigerator;

an insulation provided between the first inner case and the outer case, between the second inner case and the outer case, and between the first inner case and the second inner case; and a cold air guide surrounded by the insulation between the first inner case and the second inner case, and configured to form a cold air flow path connecting the first storage compartment and the second storage compartment, wherein:

the plurality of first plates comprise a first lower plate forming a lower surface of the first storage compartment, the plurality of second plates comprise a second upper plate forming an upper surface of the second storage compartment, the first lower plate comprises a first hole formed through the first lower plate, the second upper plate comprises a second hole formed through the second upper plate the first lower plate comprises a first sealing rib continuously formed along a circumference of the first hole and protruding downward from the first lower plate, and the second upper plate comprises a second sealing rib continuously formed along a circumference of the second hole and protruding upward from the second upper plate.

2. The refrigerator of claim 1, wherein:

the cold air guide is configured to connect the first hole and the second hole to form the cold air flow path.

3. The refrigerator of claim 1, wherein:

the cold air guide and the first lower plate are sealed to prevent the insulation from flowing into the cold air flow path through the cold air guide and the first lower plate, and the cold air guide and the second upper plate are sealed to prevent the insulation from flowing into the cold air flow path through the cold air guide and the second upper plate.

4. The refrigerator of claim 1, wherein:

the cold air guide comprises:

a first flange provided at one end of the cold air guide and coupled to the first lower plate to cover the first hole and the first sealing rib; and a second flange provided at another end of the cold air guide and coupled to the second upper plate to cover the second hole and the second sealing rib.

5. The refrigerator of claim 4, wherein a lower end of the first sealing rib is provided to contact the first flange so as to prevent inflow of the insulation.

6. The refrigerator of claim 4, wherein an upper end of the second sealing rib is provided to contact the second flange so as to prevent inflow of the insulation.

7. The refrigerator of claim 5, wherein:

the lower end of the first sealing rib is provided to contact the first flange, when the cold air guide is located at a predetermined position with respect to the first lower plate, and the first lower plate further comprises a guide configured to guide the cold air guide to allow the cold air guide to be located at the predetermined position.

8. The refrigerator of claim 7, wherein:

the guide comprises a guide surface configured to contact the first flange so as to guide the first flange, when the cold air guide moves toward the first lower plate to be coupled to the first lower plate, and the first flange is guided to the predetermined position by moving along the guide surface.

9. The refrigerator of claim 6, wherein:

the second upper plate comprises a flange coupler coupled to the second flange to fix the cold air guide to the second upper plate, and the upper end of the second sealing rib is provided to contact the second flange, when the second flange is coupled to the flange coupler.

10. The refrigerator of claim 9, wherein the flange coupler comprises:

a coupling rib forming a flange groove into which the second flange is inserted;

a cover provided to cover one end of the second flange and extending from the coupling rib; and a coupling protrusion provided on the coupling rib and coupled to the second flange to prevent the second flange from being withdrawn from the flange groove.

11. The refrigerator of claim 10, wherein the cold air guide comprises:

a first recess formed by recessing a portion of the second flange and covered by the cover, and a second recess formed by recessing a portion of the second flange to allow the coupling protrusion to be inserted.

12. The refrigerator of claim 1, wherein:

the plurality of first plates comprise a first lower plate forming a lower surface of the first storage compartment, the plurality of second plates comprise a second upper plate forming an upper surface of the second storage compartment, the refrigerator further comprises:

a first support protrusion that protrudes downward from the first lower plate, and a second support protrusion that protrudes upward from the second upper plate, and the first support protrusion and the second support protrusion contact each other to maintain a gap between the first inner case and the second inner case.

13. The refrigerator of claim 12, wherein:

the first support protrusion is formed integrally with the first lower plate, and the second support protrusion is formed integrally with the second upper plate.

14. The refrigerator of claim 12, wherein the first support protrusion and the second support protrusion are provided to contact at two regions spaced apart from each other to reduce a contact area between the first support protrusion and the second support protrusion.

15. A refrigerator comprising:

a first inner case forming a first storage compartment and including a first lower plate and a plurality of first plates each formed by injection molding;

a second inner case forming a second storage compartment and including a second upper plate and a plurality of second plates each formed by injection molding;

an outer case coupled to an outer side of the first inner case and an outer side of the second inner case to form an exterior of the refrigerator;

an insulation provided between the first inner case and the outer case, between the second inner case and the outer case, and between the first inner case and the second inner case;

a first support protrusion that protrudes downward from the first lower plate, a second support protrusion that protrudes upward from the second upper plate and contacts the first support protrusion to maintain a gap between the first inner case and the second inner case; and a cold air guide disposed between the first inner case and the second inner case to maintain the gap between the first inner case and the second inner case, and configured to form a cold air flow path connecting the first storage compartment and the second storage compartment.

16. The refrigerator of claim 15, wherein first lower plate include:

a first hole formed through the first lower plate, and a first sealing rib formed along a circumference of the first hole and protruding downward from the first lower plate.

17. The refrigerator of claim 16, wherein the second upper plate include:

a second hole formed through the second upper plate, and a second sealing rib formed along a circumference of the second hole and protruding upward from the second upper plate.

18. The refrigerator of claim 17, wherein the cold air guide include:

a first flange provided at one end of the cold air guide and coupled to the first lower plate to cover the first hole and the first sealing rib; and a second flange provided at another end of the cold air guide and coupled to the second upper plate to cover the second hole and the second sealing rib.

19. The refrigerator of claim 18, wherein a lower end of the first sealing rib is provided to contact the first flange so as to prevent inflow of the insulation.

* * * * *